US011473729B2

(12) United States Patent
Jones et al.

(10) Patent No.: US 11,473,729 B2
(45) **Date of Patent: *Oct. 18, 2022**

(54) MULTIPLE HEAD DOSING ARM DEVICE, SYSTEM AND METHOD

(71) Applicant: Chart Inc., Ball Ground, GA (US)

(72) Inventors: Bryson Tyler Jones, Marietta, GA (US); Paul Kunst Rybak, Gilroy, CA (US); Shannon Bobo, Canton, GA (US)

(73) Assignee: Chart Inc., Ball Ground, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/553,963

(22) Filed: Aug. 28, 2019

(65) Prior Publication Data

US 2019/0383444 A1 Dec. 19, 2019

Related U.S. Application Data

(63) Continuation-in-part of application No. 15/787,859, filed on Oct. 19, 2017, now Pat. No. 10,451,221.
(Continued)

(51) Int. Cl.
*F17C 9/00* (2006.01)
*F17C 13/04* (2006.01)

(52) U.S. Cl.
CPC ..... *F17C 9/00* (2013.01); *F17C 13/04* (2013.01); *F17C 2203/0391* (2013.01);
(Continued)

(58) Field of Classification Search
CPC .... F17C 9/02; F17C 3/08; F17C 3/085; F17C 7/02; F17C 13/04; F17C 2203/0391;
(Continued)

(56) References Cited

U.S. PATENT DOCUMENTS 1,092,533 A * 4/1914 Kanellos ..... B67D 7/3209 141/183
2,080,103 A * 5/1937 Zarstschenzeff ..... A23L 3/361 62/63

(Continued)

FOREIGN PATENT DOCUMENTS

CN 103591454 A 2/2014
FR 2748547 A1 11/1997

OTHER PUBLICATIONS

FR 2748547_Machine Translation, Daniel Goumy, Nov. 14, 1997.*

(Continued)

*Primary Examiner* — Benjamin R Shaw
*Assistant Examiner* — Randall A Gruby
(74) *Attorney, Agent, or Firm* — Cook Alex Ltd.

(57) ABSTRACT

A doser for dispensing a cryogenic fluid includes a doser body configured to receive the cryogenic fluid. A dosing arm has a proximal end and a distal end, with a central passage extending between the proximal and distal ends and configured to receive cryogenic fluid from the doser body. Multiple dosing heads are mounted to the distal end of the dosing arm with each of the dosing heads including a dosing valve. The dosing heads are configured to receive cryogenic fluid from the central passage of the dosing arm and to dispense the cryogenic fluid when the dosing valve is opened.

18 Claims, 21 Drawing Sheets

Related U.S. Application Data

(60) Provisional application No. 62/725,109, filed on Aug. 30, 2018, provisional application No. 62/409,980, filed on Oct. 19, 2016.

(52) U.S. Cl.
CPC .. *F17C 2221/014* (2013.01); *F17C 2223/013* (2013.01); *F17C 2227/0121* (2013.01)

(58) Field of Classification Search
CPC ... F17C 2203/0395; F16L 51/02; F16L 59/06; F16L 59/065
See application file for complete search history.

(56) References Cited

U.S. PATENT DOCUMENTS 2,406,234 A * 8/1946 Marancik et al. .... F16L 51/027 285/227
2,713,503 A * 7/1955 Ekholm ..... F16L 51/027 285/139.2
2,732,227 A * 1/1956 Kaiser ..... F16L 59/21 285/47
3,016,717 A * 1/1962 Gottzmann ..... F04B 53/166 417/901
3,028,729 A * 4/1962 Ledwith ..... F02K 9/46 60/266
3,068,026 A * 12/1962 Mckamey ..... F16L 39/005 62/50.7
3,122,004 A * 2/1964 Aberle ..... H01F 6/04 62/51.1
3,131,713 A * 5/1964 Kelley ..... F04B 43/08 137/340
3,134,237 A * 5/1964 Canty ..... F17C 3/08 62/48.3
3,137,143 A * 6/1964 Richards ..... F16L 59/065 62/50.7
3,270,769 A * 9/1966 Kaiser ..... F16L 59/065 138/148
3,272,579 A * 9/1966 Leonard ..... F17C 3/08 220/592.27
3,316,931 A * 5/1967 Elrod ..... F16L 59/141 137/339
3,341,215 A * 9/1967 Spector ..... F17C 13/086 280/837
3,364,689 A * 1/1968 Johnson ..... F16L 53/00 62/50.7
3,372,635 A * 3/1968 Meyer ..... A47J 37/044 126/41 R
3,377,813 A * 4/1968 Mordhorst ..... F17C 3/08 62/45.1
3,423,955 A * 1/1969 Wright ..... F17C 3/085 62/51.1
3,433,028 A * 3/1969 Klee ..... F16L 59/141 62/50.7
3,446,388 A * 5/1969 Greenberg ..... F17C 13/086 220/562
3,483,709 A * 12/1969 Sayres ..... F17C 3/085 62/51.1
3,573,863 A * 4/1971 Doors ..... F16K 51/02 137/375
3,765,705 A * 10/1973 Tantam ..... F16L 59/16 285/47
3,782,128 A * 1/1974 Hampton ..... F17C 3/08 62/45.1
3,876,235 A * 4/1975 Flint ..... F16L 27/12 285/93
3,945,215 A * 3/1976 Johnson ..... F16L 51/02 62/50.7
3,972,202 A * 8/1976 Stearns ..... F17C 9/02 62/50.1
4,011,732 A * 3/1977 Doherty ..... F16L 39/005 62/50.7
4,017,102 A * 4/1977 Henderson ..... F16L 23/08 285/41
4,038,832 A * 8/1977 Lutgen ..... F17C 13/086 62/45.1
4,075,869 A * 2/1978 Fitsall ..... F25D 3/11 62/374
4,099,746 A * 7/1978 Kontsch ..... H01B 12/00 285/119
4,103,507 A * 8/1978 Benois ..... A23L 3/361 62/225
4,336,694 A * 6/1982 Schmitt ..... F25D 3/10 239/568
4,441,327 A * 4/1984 Klee ..... F17C 13/00 236/102
4,491,347 A * 1/1985 Gustafson ..... F16L 59/141 285/353
4,589,264 A * 5/1986 Astrom ..... F25D 3/11 62/374
4,715,187 A * 12/1987 Stearns ..... F17C 9/00 62/50.1
4,877,153 A * 10/1989 Varghese ..... F17C 3/08 220/560.1
4,944,155 A * 7/1990 Alexander ..... F17C 3/08 62/268
5,450,732 A * 9/1995 Venetucci ..... F17C 9/02 62/374
5,460,015 A * 10/1995 Venetucci ..... A23L 3/362 62/374
5,946,922 A * 9/1999 Viard ..... A23L 3/36 236/51
6,641,174 B2 * 11/2003 Klok ..... F16K 35/00 285/1
7,052,047 B1 * 5/2006 Box ..... F16L 59/184 285/123.15
7,114,535 B2 * 10/2006 Hartness ..... B67C 3/24 141/180
8,590,942 B2 * 11/2013 Kouketsu ..... F16L 39/005 285/123.12
9,228,770 B2 * 1/2016 Owens ..... F25D 3/10
9,688,927 B2 * 6/2017 Chen ..... C10J 3/86
2004/0239108 A1 * 12/2004 Bonn ..... F16L 59/065 285/123.1
2005/0086949 A1 * 4/2005 Noble ..... F02M 21/0221 62/50.1
2006/0010886 A1 * 1/2006 Clamage ..... A23L 2/54 62/52.1
2011/0036555 A1 * 2/2011 Plicht ..... B21B 45/0209 72/201
2011/0265492 A1 * 11/2011 Newman ..... F25D 3/11 62/347
2018/0112824 A1 * 4/2018 Gaddis ..... F17C 5/04
2018/0119884 A1 5/2018 Gaddis et al.

OTHER PUBLICATIONS

International Search Report and Written Opinion by the International Search Authority for International Application No. PCT/US2019/048554, dated Dec. 10, 2019 , (15 pages).

* cited by examiner

MULTIPLE HEAD DOSING ARM DEVICE, SYSTEM AND METHOD

CLAIM OF PRIORITY

This application claims the benefit of U.S. Provisional Application No. 62/725,109, filed Aug. 30, 2018, and is a Continuation-in-Part of U.S. patent application Ser. No. 15/787,859, filed Oct. 19, 2017, which claims the benefit of U.S. Provisional Application No. 62/409,980, filed Oct. 19, 2016, the contents of each of which are hereby incorporated by reference.

FIELD OF THE INVENTION

The present disclosure relates generally to cryogenic fluid dispensing systems and, in particular, to a dosing arm that includes multiple heads for cryogenic fluid dosers.

BACKGROUND

Cryogenic fluids, that is, fluids having a boiling point generally below −150° C. at atmospheric pressure, are used in a variety of industrial applications. One example is in the packaging of food, beverages and other products.

One part of liquid nitrogen (a cryogenic fluid) warms and expands into 700 parts of gaseous nitrogen at ambient temperature. Based on this characteristic, automated dosing equipment and systems have been developed that precisely dispense measured doses of liquid nitrogen into product containers prior to sealing. The trapped liquid nitrogen vaporizes and thus creates pressure within the container so as to add rigidity to the container. This allows for a use of a thinner container wall which reduces material costs and weight. Alternatively, for preservation and modified packaging (MAP) applications, the rapidly expanding gas is allowed to escape before the product packaging is sealed, flushing out oxygen and extending product life. In still another application, a dose of liquid nitrogen is introduced to "lock in" and surface freeze the food product (such as novelty ice cream).

A typical prior art dosing system is illustrated in FIG. 1. The liquid nitrogen is stored in a vacuum-insulated bulk tank 20 and transferred, via vacuum-insulated piping 22, to a phase separator 24. Liquid nitrogen is then provided via line 26 to a doser, indicated in general at 28. The doser includes a doser body 30 which houses an insulated cryogen source reservoir that receives the liquid nitrogen from line 26. A dosing arm 32 is connected to the doser body 30 and is in communication with the cryogen source reservoir. A dosing head 34 is positioned on the distal end of the dosing arm. The dosing arm 32 includes vacuum-insulated piping so that liquid nitrogen is supplied from the cryogen source reservoir of the doser body to the dosing head 34. A conveyer of a product packaging system passes below the dosing head. The dosing head includes a valve that dispenses or injects droplets including very precise amounts of liquid nitrogen into product containers as they pass below the dosing head on the conveyer.

Currently multiple dosers must be used to dose multiple lines or containers at one time. This is expensive and increases warranty coverage and maintenance fees. Creating one dosing arm feeding more than one dosing head is more cost effective for manufacturing and consumers.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a doser for dispensing a cryogenic fluid includes a doser body configured to receive the cryogenic fluid. A dosing arm having a proximal end and a distal end has a central passage extending between the proximal and distal ends that is configured to receive cryogenic fluid from the doser body. Multiple dosing heads are mounted to the distal end of the dosing arm with each of the dosing heads including a dosing valve. The dosing heads are configured to receive cryogenic fluid from the central passage of the dosing arm and to dispense the cryogenic fluid when the dosing valve is opened.

In another aspect, a dosing arm includes a proximal end and a distal end and a central passage extending between the proximal and distal ends that is configured to receive a cryogenic fluid. Multiple dosing heads are mounted to the distal end with each of the plurality of dosing heads including a dosing valve. Each dosing head is configured to receive cryogenic fluid from the central passage and to dispense the cryogenic fluid when the dosing valve is opened.

In yet another aspect, a method of dosing a plurality of receptacles with a cryogenic liquid includes the steps of storing a supply of the cryogenic liquid in a doser body; directing a stream of the cryogenic liquid through a central passage of a single dosing arm to a plurality of dosing heads, each of the plurality of dosing heads including a dosing valve; positioning the plurality of receptacles under the plurality of dosing heads; and selectively opening and closing the dosing valves of the plurality of dosing heads.

DETAILED DESCRIPTION OF EMBODIMENTS

Embodiments of the invention provide multiple dosing heads mounted on a single dosing arm or dosing arm assembly.

Figure 1:
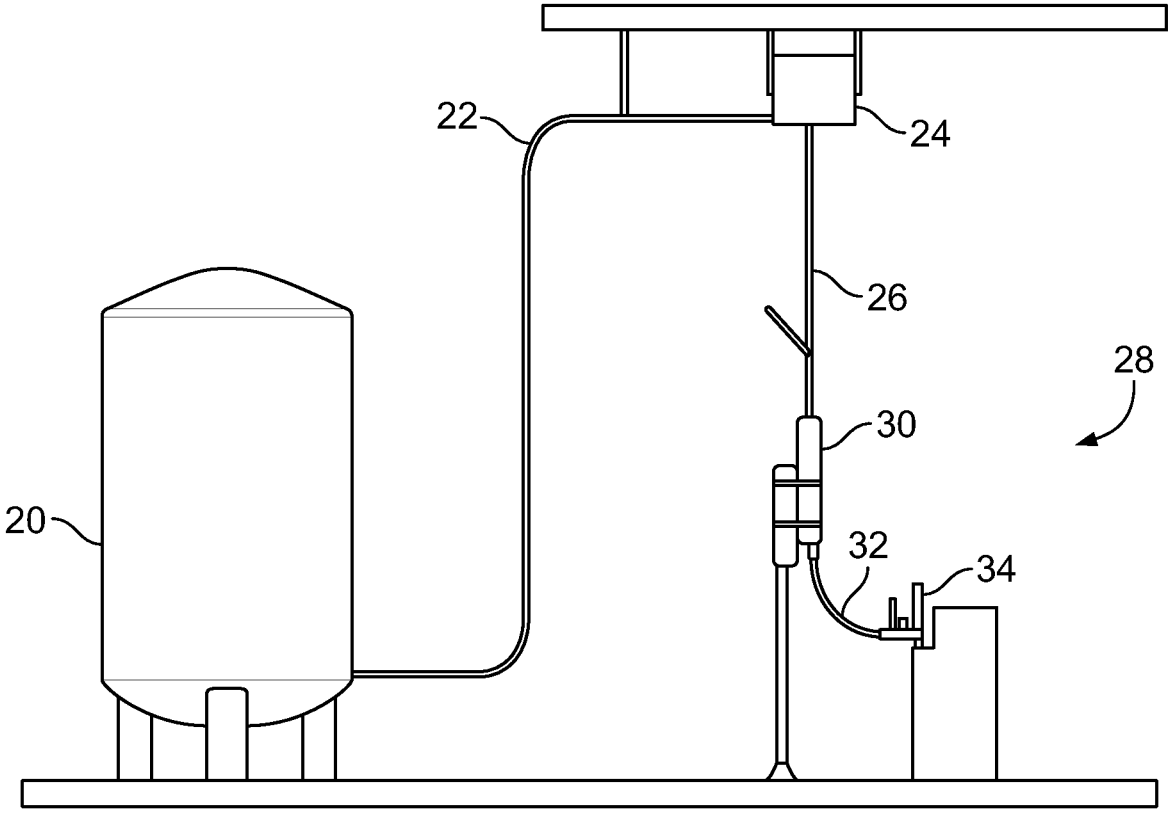
FIG. 1 Prior Art
FIG. 1 is a schematic view of a prior art dosing system.
Figure 2:
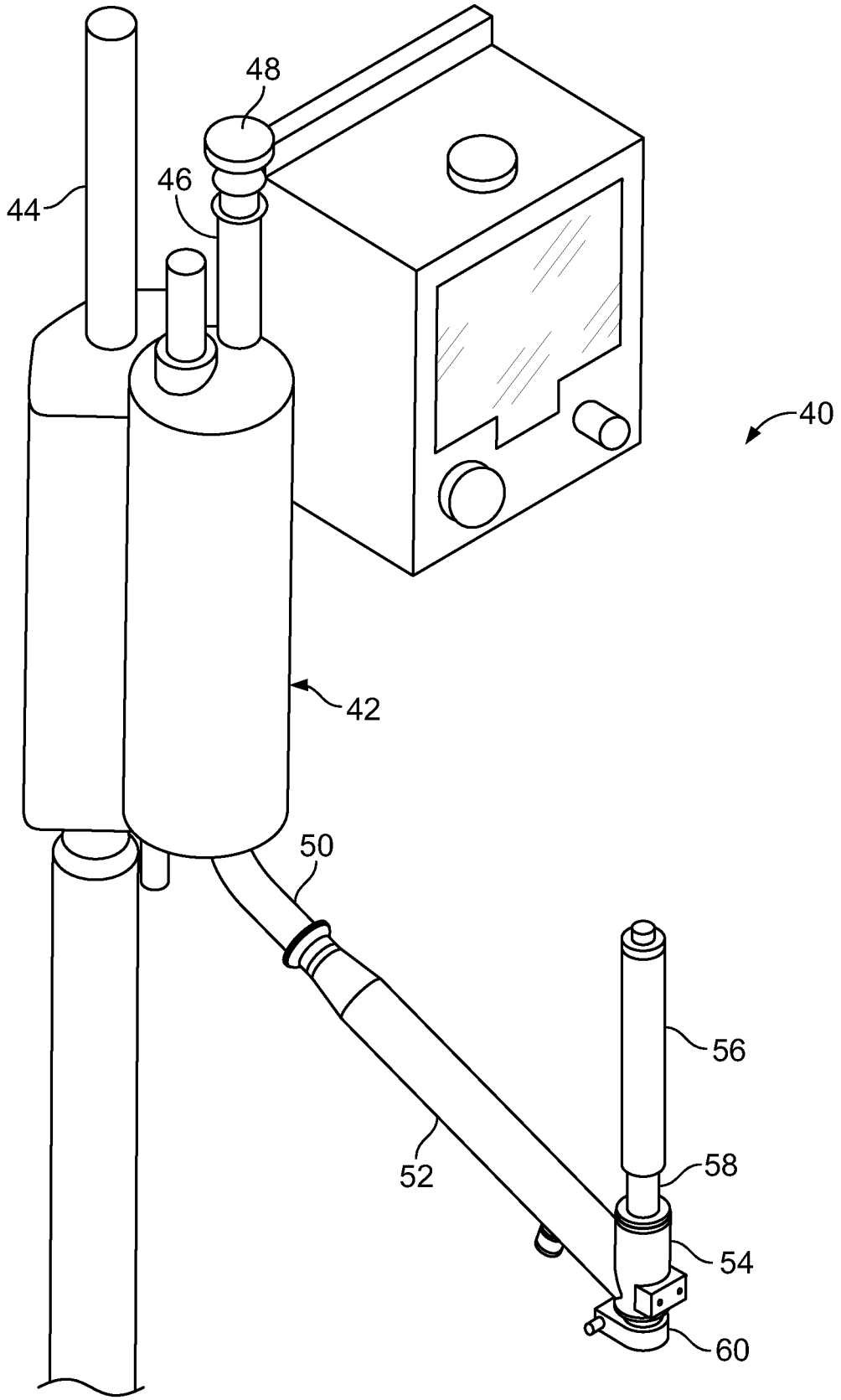
FIG. 2 is a perspective view of an embodiment of a doser.

A doser including an embodiment of the interchangeable dosing arm of the disclosure is indicated in general at 40 in FIG. 2. The doser includes a doser body 42 mounted upon a column 44 of a stand. The doser body, as described previously with reference to FIG. 1, receives liquid nitrogen via inlet fitting 46 that is attached to a liquid nitrogen supply line via clamp 48 (also shown in FIGS. 3 and 4).

Figure 3:
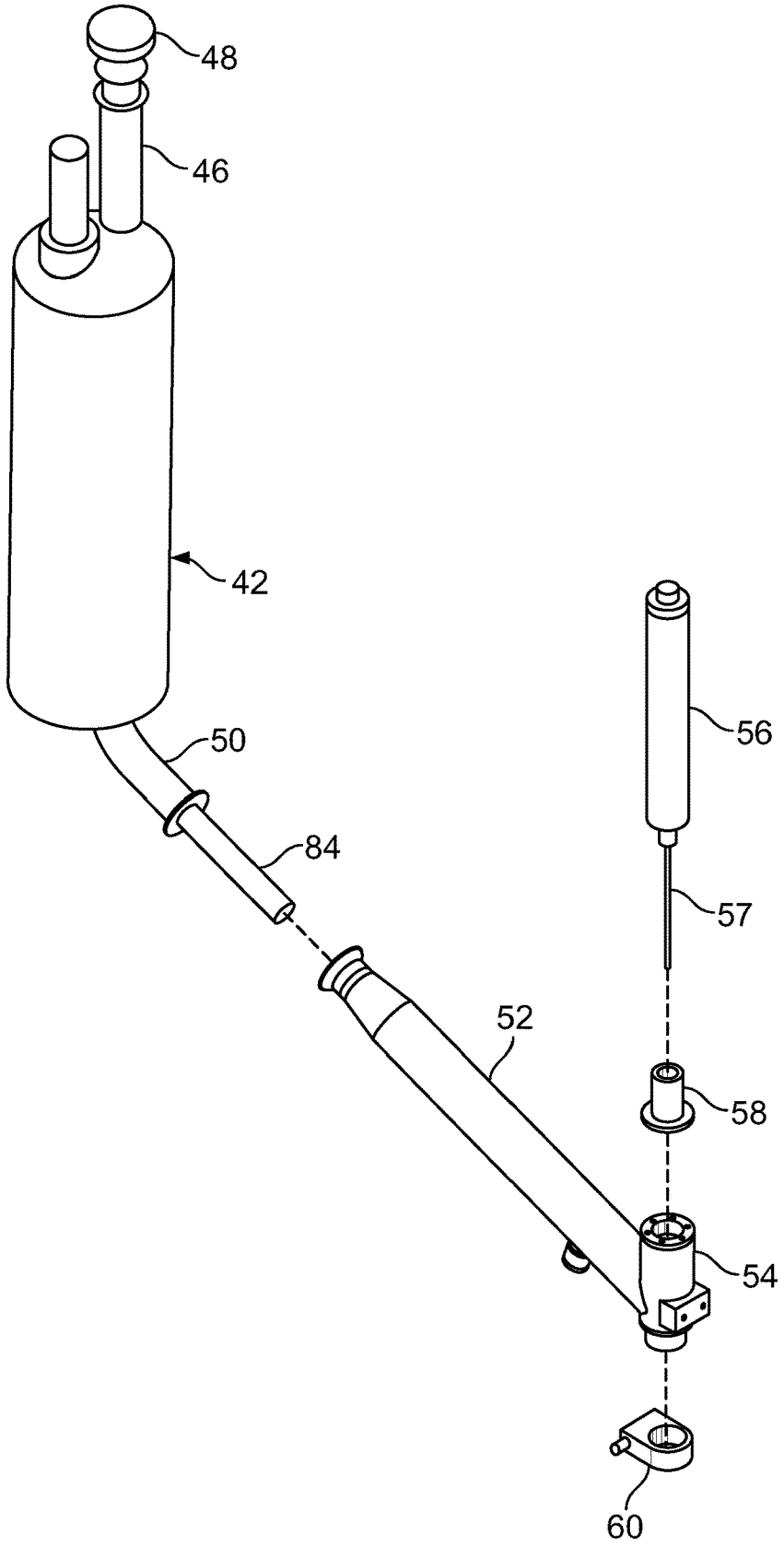
FIG. 3 is an exploded view of the doser of FIG. 2.

With reference to FIGS. 2 and 3, a vacuum insulated gooseneck shaped outlet fitting 50 exits the bottom of the doser body and, as described in greater detail below, is attached via a bayonet connection to a vacuum insulated dosing arm 52. A dosing head 54 is positioned upon the distal end of the dosing arm and, as explained in greater detail below, houses a dosing valve. A dosing valve actuator 56 is mounted to the top of the dosing head 54 via an adaptor 58 and actuates valve stem 57 to open and close the dosing valve within the dosing head 54. As a result, droplets of liquid nitrogen are dispensed in very precise amounts through optional heater plate 60, which is attached to the bottom of the dosing head.

Figure 4:
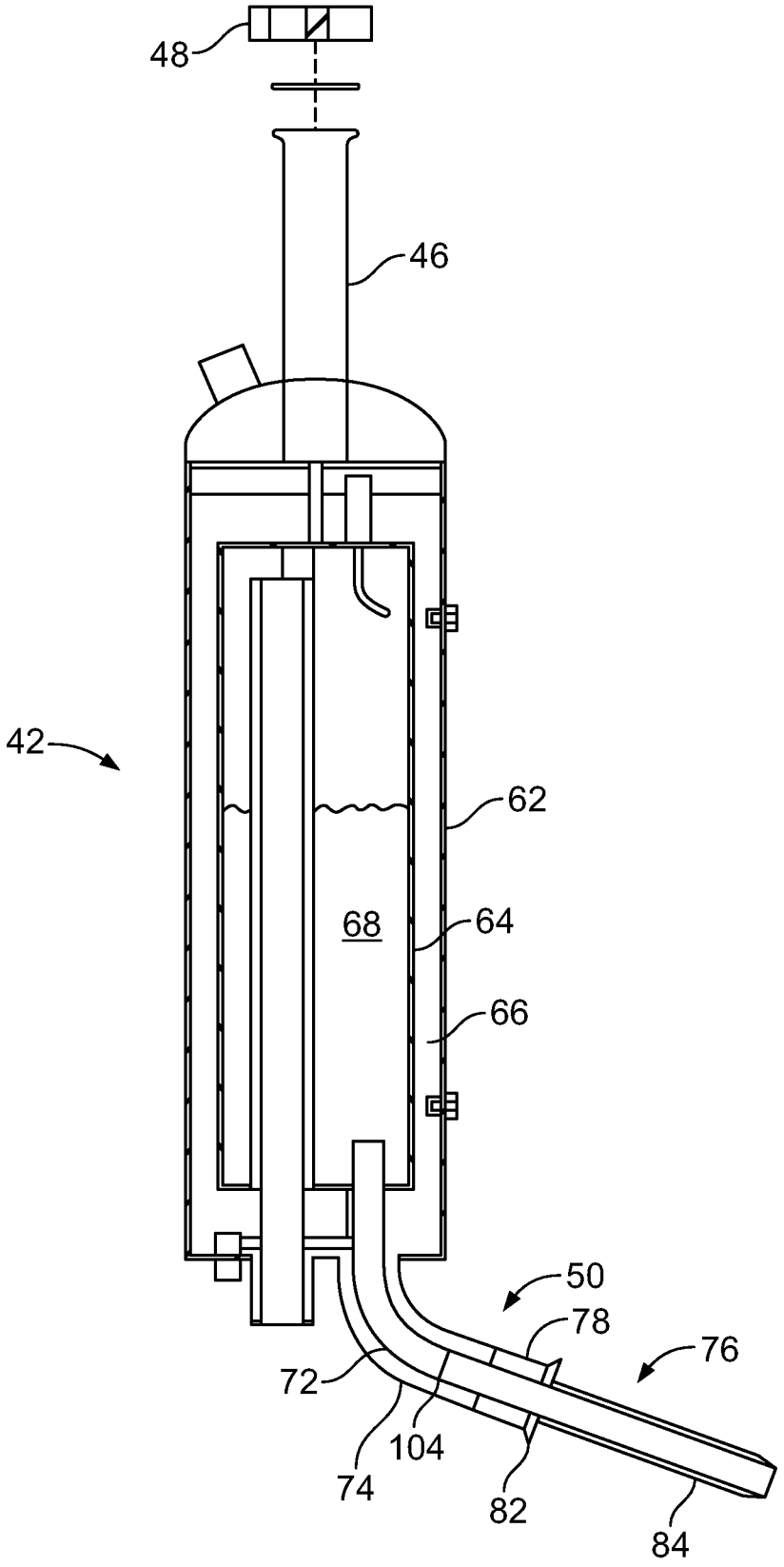
FIG. 4 is a cross sectional view of the doser body, outlet fitting and male bayonet connector of FIGS. 1-3.

With reference to FIG. 4, the doser body, indicated in general at 42, houses a vacuum insulated reservoir that receives the liquid nitrogen. More specifically, the doser body 42 includes an outer jacket 62 and an inner tank 64, with the space therebetween 66 evacuated of air so that the vacuum insulated reservoir is provided. A supply of liquid nitrogen 68 (received from inlet fitting 46) is stored within the inner tank 64. As an example only, further details regarding the construction of the doser body may be as illustrated in U.S. Pat. No. 6,182,715 to Ziegler et al., the contents of which are hereby incorporated by reference. In addition, the contents of commonly assigned U.S. patent application Ser. No. 15/787,859 (U.S. Patent Appl. Publication No. U.S. 2018/0119884) to Gaddis et al. are also hereby incorporated by reference.

Figure 5A:
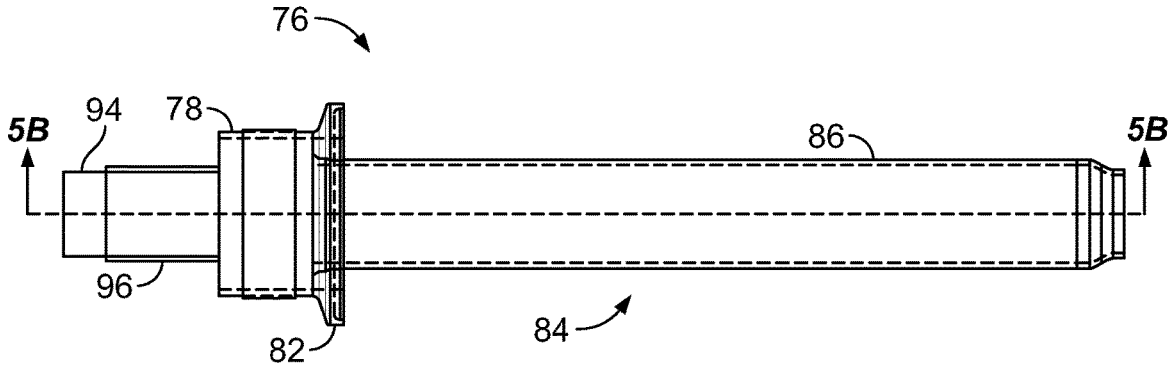
FIG. 5A is an enlarged view of the male bayonet connector of FIG. 4.
Figure 5B:
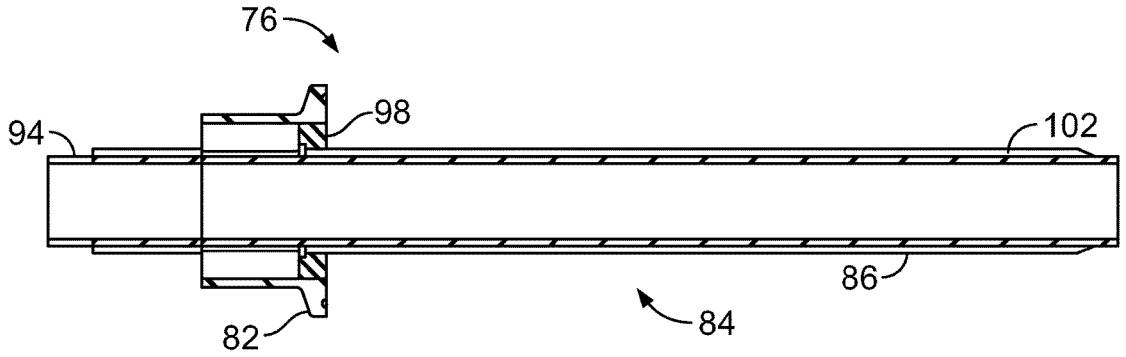
FIG. 5B is a cross sectional view of the male bayonet connector of FIG. 5A taken along line 5B-5B.

The doser body outlet fitting, indicated in general at 50 in FIG. 4, features an inner pipe 72 and an outer jacket 74. A male bayonet connector, indicated in general at 76 in FIGS. 4, 5A and 5B, is positioned at the distal end of the gooseneck shaped outlet fitting. The male bayonet connector includes a sleeve 78, which is circumferentially attached and sealed to outer jacket 74 by welding, brazing, adhesive or other arrangements known in the art. The sleeve 78 is provided with an annular flange 82. An insertion stem 84 extends from the sleeve flange.

Figure 6:
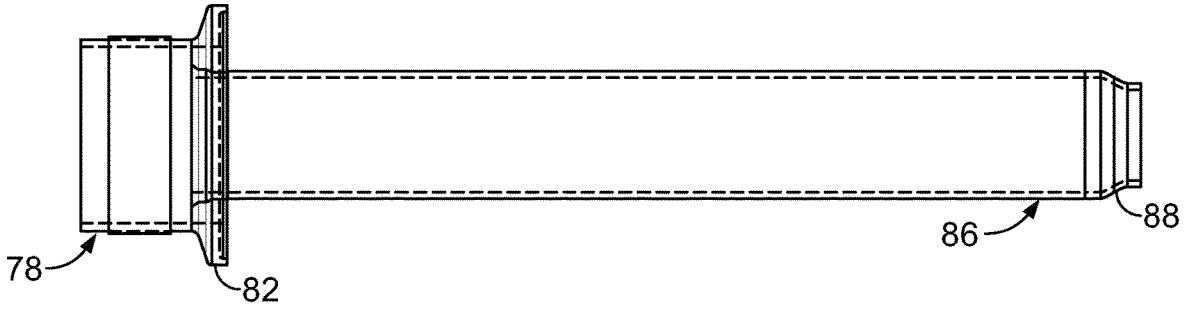
FIG. 6 is a side elevational view of the sleeve, flange and insertion stem outer jacket of the male bayonet connector of FIGS. 5A and 5B.

The insertion stem 84 of the male bayonet connector includes a tubular stem jacket, indicated at 86 in FIGS. 5A, 5B and 6. As illustrated in FIG. 6, the stem jacket 86 includes a circumferentially tapered distal tip portion 88. A male bayonet connector insert, indicated in general at 92 in FIG. 7, includes an inner pipe 94 which is optionally provided with a wrap 96. As examples only, the inner pipe 94 may be constructed from stainless steel, and the wrap 96 may be CRS WRAP available from Lydall, Inc. of Rochester, N.H. The insert 92 also includes a flange bushing 98, which may be made of, as examples only, 304 stainless steel or 316 L stainless steel.

Figure 7:
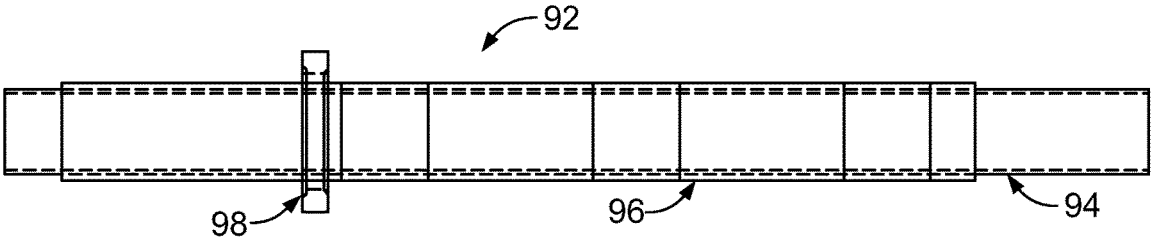
FIG. 7 is a side elevational view of the insert of the male bayonet connector of FIGS. 5A and 5B.

As illustrated in FIGS. 5A and 5B, the insert 92 of FIG. 7 is inserted through a central passage formed by the sleeve 78 and stem jacket 86 of FIG. 6. As a result, the flange bushing 98 is received within the sleeve 78 in a sealing fashion. The distal tip of the inner pipe is circumferentially attached and sealed to the tip of the taper distal tip portion 88 of the jacket 86 by welding, brazing, adhesive or other attachment arrangements known in the art. As a result, an annular insulation space, indicated at 102 in FIG. 5B is formed. As indicated at 104 in FIG. 4, the proximal end of the of the inner pipe 94 abuts the distal end of the inner pipe 72 of the outlet fitting 50 and is circumferentially attached and sealed thereto by welding, brazing, adhesive or other arrangements known in the art.

Figure 8:
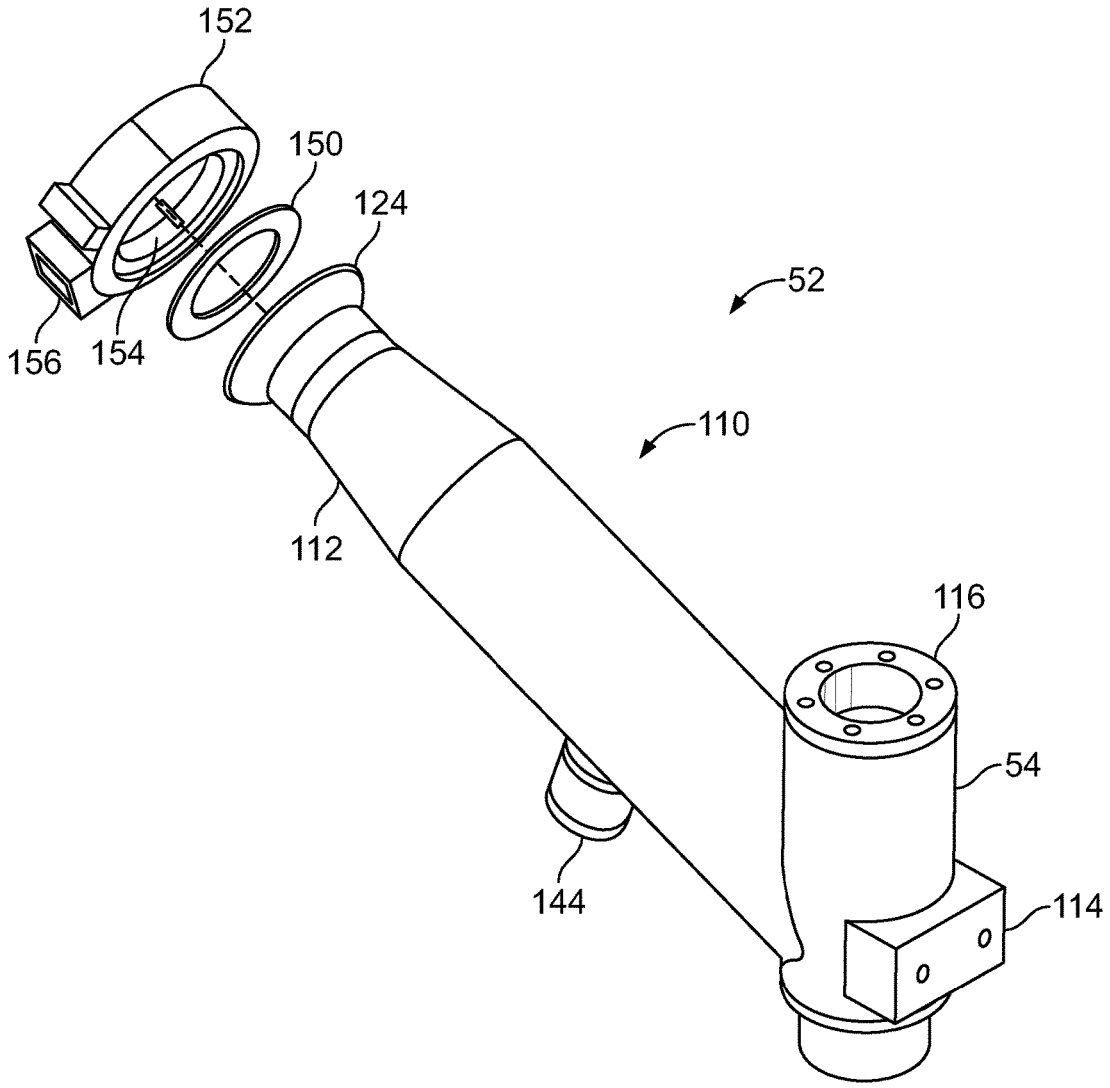
FIG. 8 is a perspective view of the dosing arm of FIGS. 2 and 3.
Figure 9:
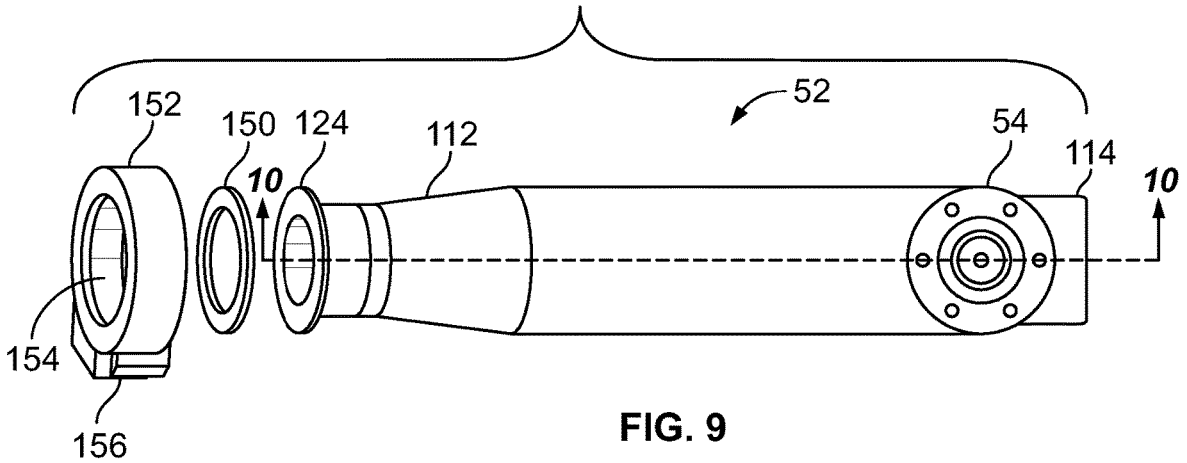
FIG. 9 is a top view of the dosing arm of FIG. 8.

Turning to FIGS. 8 and 9, the dosing arm of FIG. 2 is indicated in general at 52 and the dosing head is indicated at 54. The dosing arm 52 includes a dosing arm outer jacket, indicated in general at 110, that includes a circumferentially tapered proximal end portion 112. The distal end of the jacket 110 is circumferentially attached and sealed to the dosing head 54. An optional mounting bracket 114 is provided on the dosing head 54 to permit components to be attached for specialized applications. The top of the dosing head 54 includes a mount 116 for attaching the dosing actuator (such as 56 in FIG. 1). As noted previously, while a single dosing head 54 is illustrated, multiple dosing heads could instead be attached to the distal end of the dosing arm 52.

Figure 10:
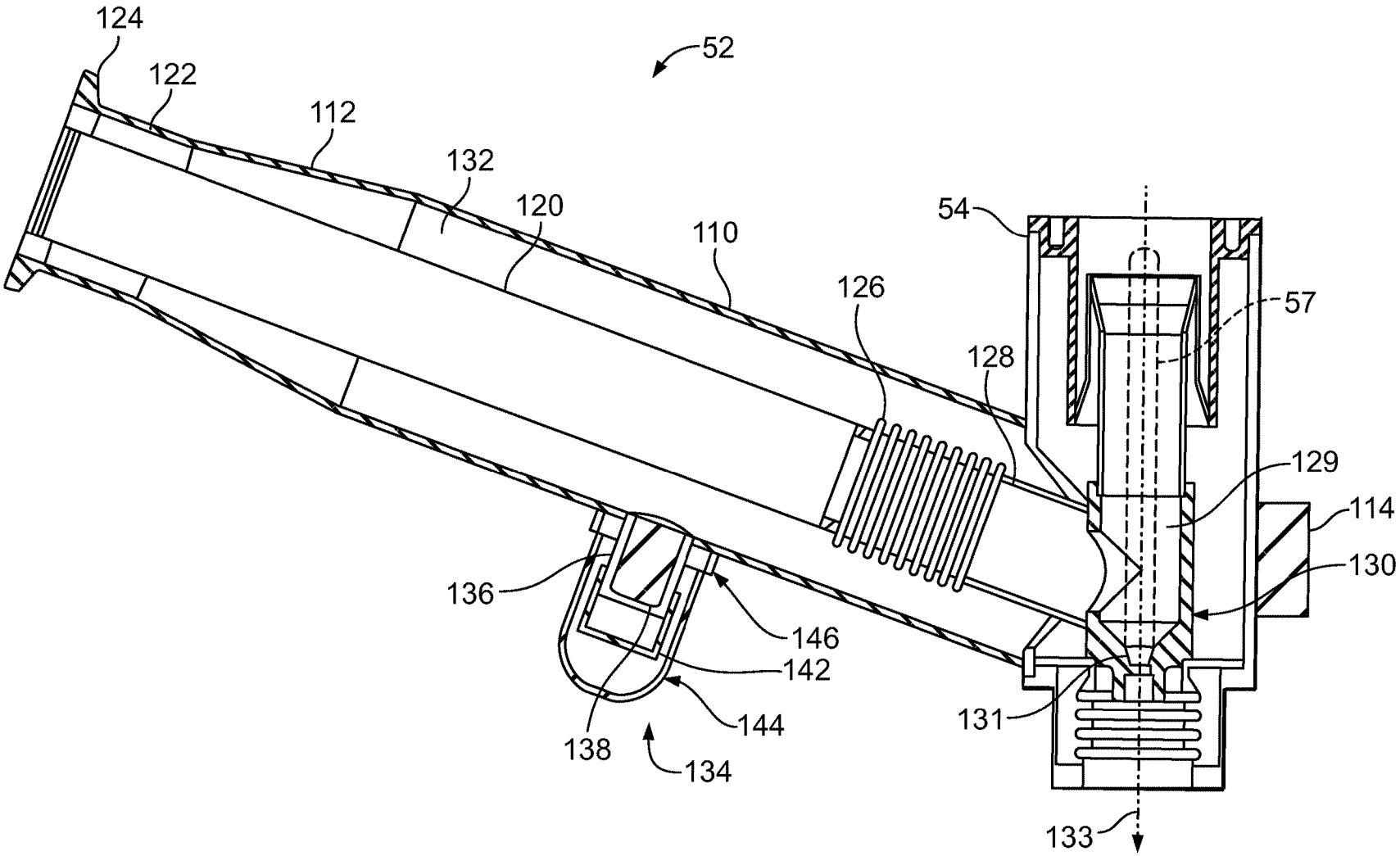
FIG. 10 is a cross sectional view of the doser of FIGS. 8 and 9 taken along line 10-10 of FIG. 9.
Figure 11:
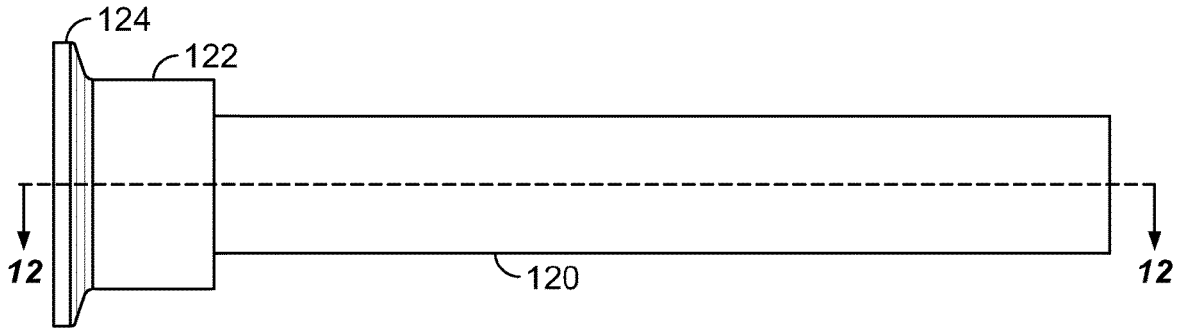
FIG. 11 is an enlarged side elevational view of the female bayonet connector of the dosing arm of FIG. 7-10.
Figure 12:
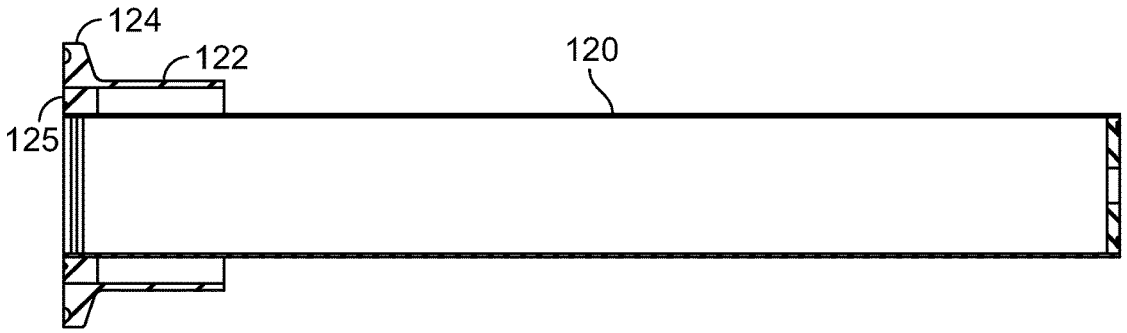
FIG. 12 is a cross sectional view of the female bayonet connector of FIG. 11 taken along line 12-12 of FIG. 11.

As illustrated in FIG. 10, a dosing arm inner pipe 120 is positioned within the outer jacket 110. As illustrated in FIGS. 11 and 12, a sleeve 122, including an annular flange 124, is circumferentially secured and sealed, via a flange bushing 125 (FIG. 12), to the proximal end of the inner pipe 120. As an example only, inner pipe 120 may be made of stainless steel. Flange bushing 125 may be made of, as examples only, 304 stainless steel or 316 L stainless steel.

Returning to FIG. 10, the sleeve 122 of FIGS. 11 and 12 is circumferentially attached and sealed to the tapered end portion 112 of the outer jacket 110 by welding, brazing, adhesive or other attachment arrangement known in the art. A bellows 126 is attached by one end to the distal end of the inner pipe 120. A pipe section 128 joins the other end of the bellows to a valve body 130. The bellows accommodates thermal expansion of the inner pipe 120 as the cold liquid nitrogen flows, and ceases to flow, therethrough. Bellows 126 may be made of, as examples only, 304 stainless steel or 316 L stainless steel.

With reference to FIG. 10, during use of the doser, liquid nitrogen flows into a supply chamber 129 defined by the valve body 130. A needle valve stem, shown in the closed position in phantom at 57, (also shown in FIG. 3) is manipulated by the dosing valve actuator (56 in FIGS. 2 and 3). When the dosing valve is opened, the valve stem 57 travels upward and away from valve seat 131. As a result, one or more droplets of liquid nitrogen from the supply chamber 129 pass out of the bottom of the dosing head 54, as indicated by arrow 133. Alternative embodiments of the dosing valve and head, and example details of the dosing valve actuator, are presented in U.S. Pat. No. 7,281,550 to Ziegler, the contents of which are hereby incorporated by reference, as well as in U.S. Pat. No. 6,182,715 to Ziegler et al., incorporated by reference previously.

The inner pipe 120 defines a central passage that is sized to receive the insertion stem 84 (FIGS. 3-5) of the male bayonet connector. As a result, a female bayonet connector is formed at the proximal end of the dosing arm 52.

An annular space 132 is defined between the inner pipe 120 and the outer jacket 110. A vacuum port assembly, indicated in general at 134 in FIG. 10, permits air to be evacuated from the annular space to provide the dosing arm with vacuum insulation. The vacuum port assembly includes a fitting 136 that defines a passage that is in fluid communication with the annular space 132. A sealing plug 138 is removably positioned within the fitting and is removed during evacuation of air from the annular space and replaced afterwards. A removable cap 142 engages the fitting 136 to cover the plug 138. A removable cover 144 engages a base 146 to protect the vacuum port assembly when not in use.

Figure 13:
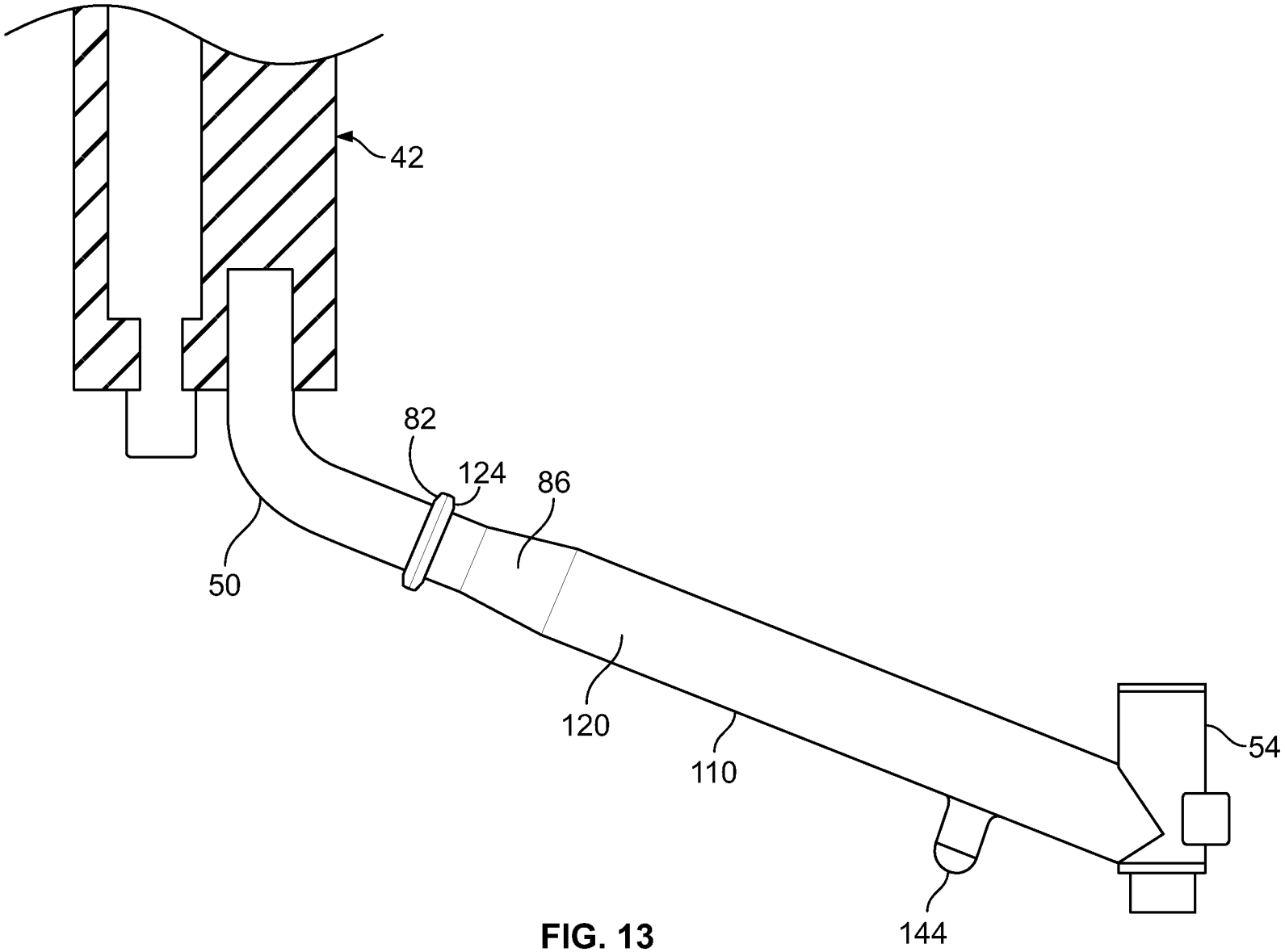
FIG. 13 is a cross sectional view of the joined male and female bayonet connectors of FIGS. 2-12.

As illustrated in FIG. 13, the male bayonet connection of FIGS. 3 and 4 is connected to the female bayonet connection of FIG. 10 by inserting the insertion stem 84 of the male bayonet connector into the central passage defined by the inner pipe 120 of the female bayonet connector. The insertion continues until the annular flange 82 of the male bayonet connector is positioned adjacent to the annular flange 124 of the female bayonet connector, as illustrated in FIG. 13. A bushing, indicated at 150 in FIGS. 8, 9 and 14A, is positioned between the annular flanges.

The bayonet connection is sealed together using the clamp indicated at 152 in FIGS. 8, 9, 14A and 14B. More specifically, as illustrated in FIGS. 8, 9, 14A and 14B, the clamp includes a central opening defined by an inner surface and an annular groove 154 formed in the inner surface. The clamp is constructed of a flexible material (such as metal) and may be closed to a reduced diameter and locked or unlocked and opened by manipulation of a latch or clasp 156. Suitable clamps are well known in the art.

Figure 14A:
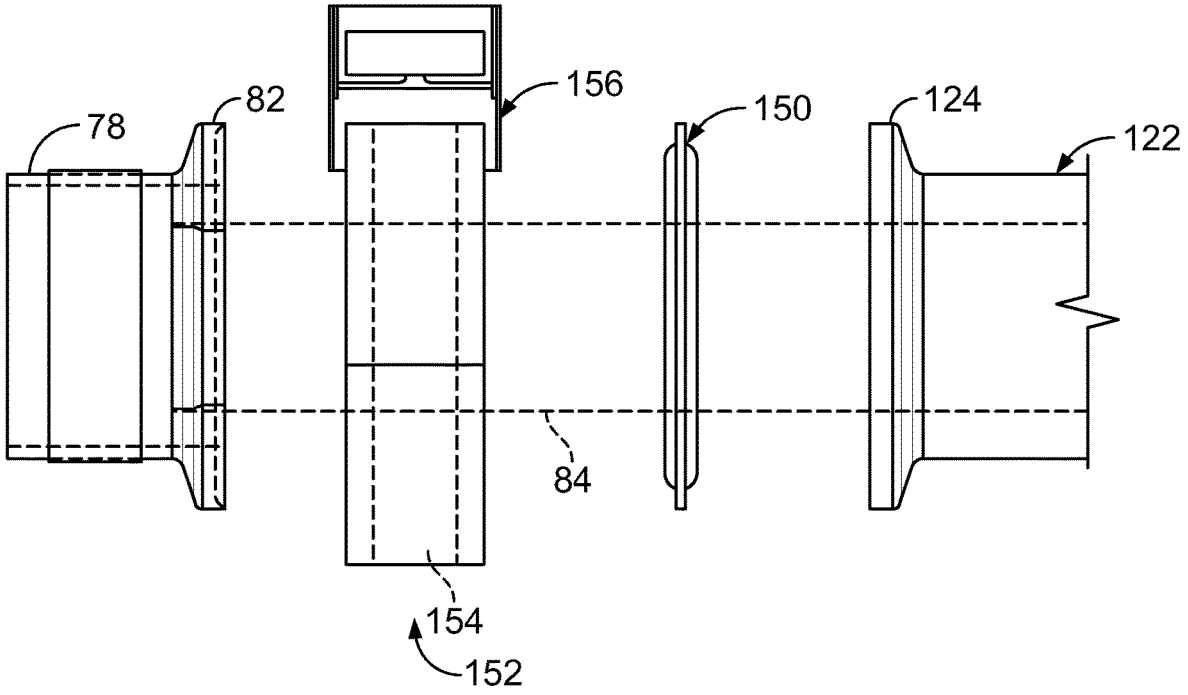
FIGS. 14A and 14B illustrate the male and female bayonet connector flanges, a bushing and a clamp prior to being joined (FIG. 14A) and after being joined and clamped (FIG. 14B)
Figure 14B:
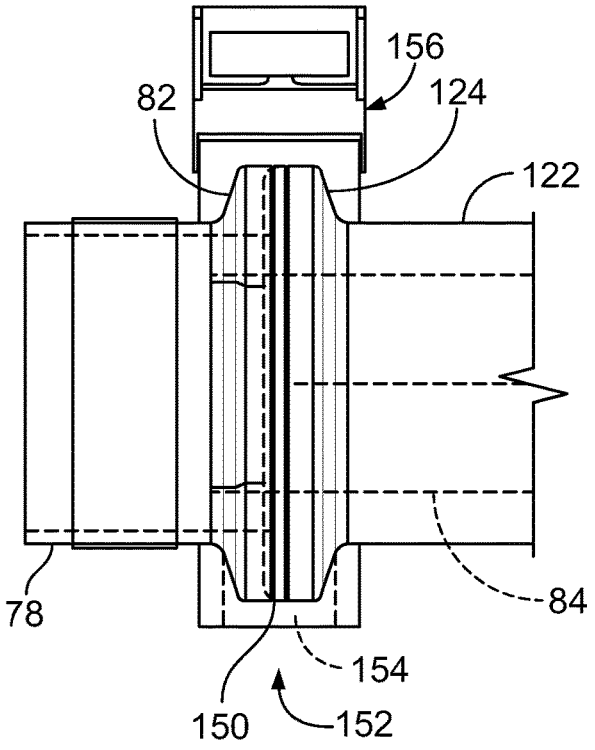

As illustrated in FIGS. 14A and 14B, the bayonet connection is locked in the configuration illustrated in FIG. 13 by placing the annular flanges 82 and 124 into the central opening of the clamp 152 with the gasket 150 positioned therebetween. The latch 156 of the clamp is then closed so that the flanges 82 and 124 are secured together within the annular groove 154 of the clamp with the gasket 150 compressed or sandwiched therebetween, as shown in FIGS. 14B and 15.

Other arrangements known in the art for securing the flanges of the male bayonet connector and the female bayonet connector may alternatively be used in place of the illustrated clamp. As an example only, the flanges may be secured together by fasteners, such as bolts, that pass through openings formed in the flanges.

In an alternative embodiment, the orientation of the male and female bayonet connectors of the bayonet connection may be reversed. More specifically, the outlet fitting 50 of the doser body could be provided with the female bayonet connector, while the proximal end of the dosing arm 52 could be provided with the male bayonet connector.

Figure 15:
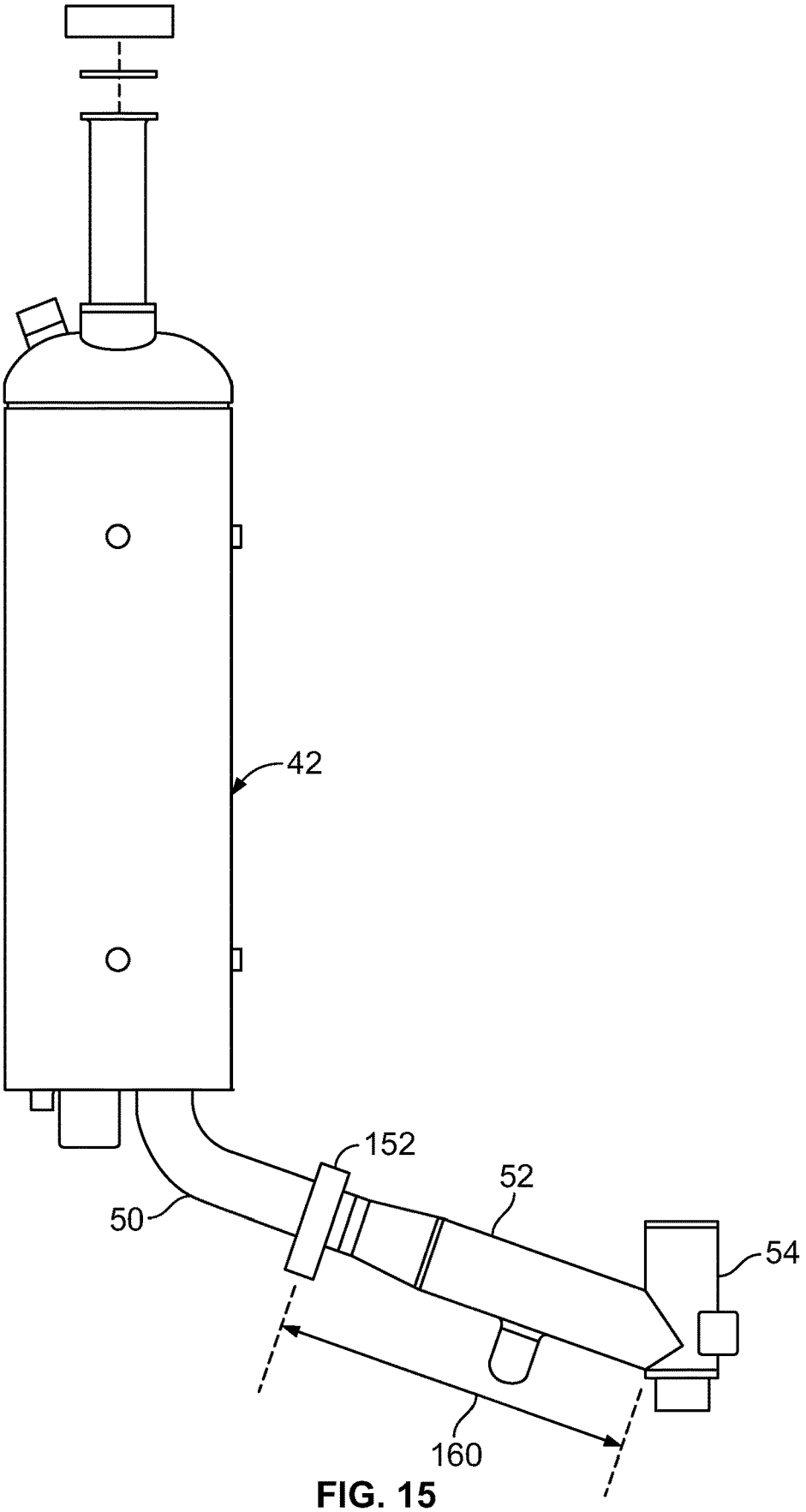
FIG. 15 is a side elevational view of the doser of FIGS. 2, 3 and 13 with the joined and clamped male and female bayonet connectors.

With reference to FIG. 15, the dosing arm 52 has a length indicated by arrows 160. If a user application requires a different length, the clamp 152 may simply be opened, the existing dosing arm removed and a different dosing arm of the same construction, but featuring a different length 160, attached to the doser outlet fitting 150 instead. As examples only, the length 160 may be 15 inches or 22.5 inches.

Using a single dosing body and interchangeable dosing arms makes the doser described above truly modular, and allows it to provide quick, inexpensive custom solutions to address unique situations that users may encounter.

Figure 16A:
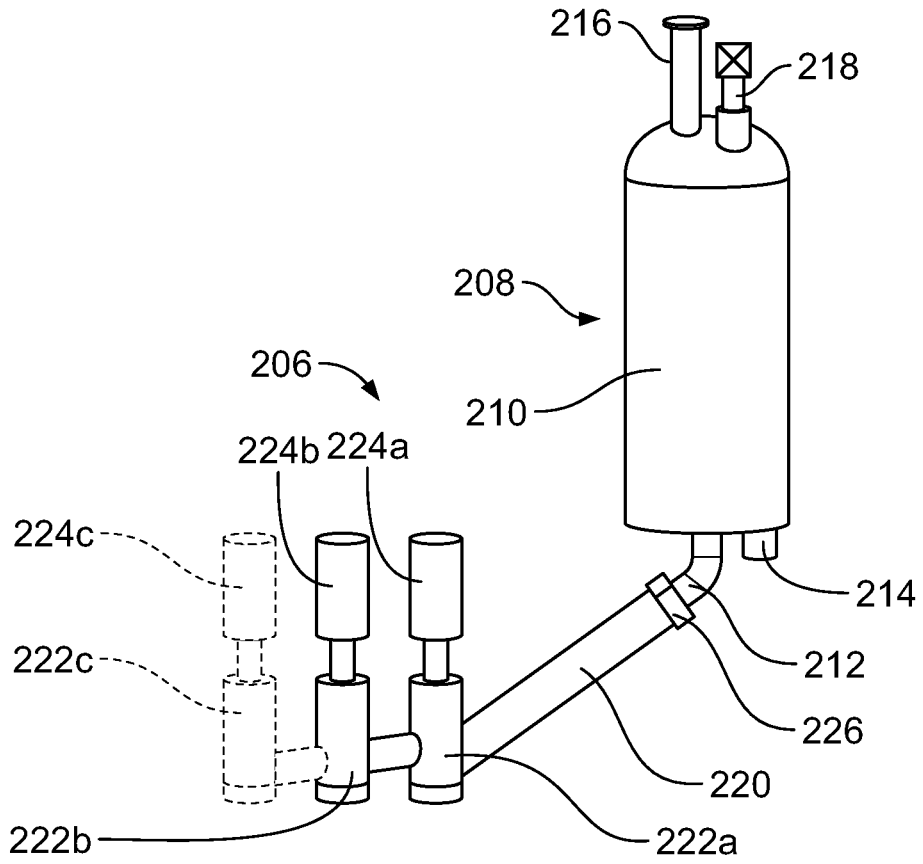
FIG. 16A is a perspective view of a first embodiment of the doser of the disclosure.
Figure 16B:
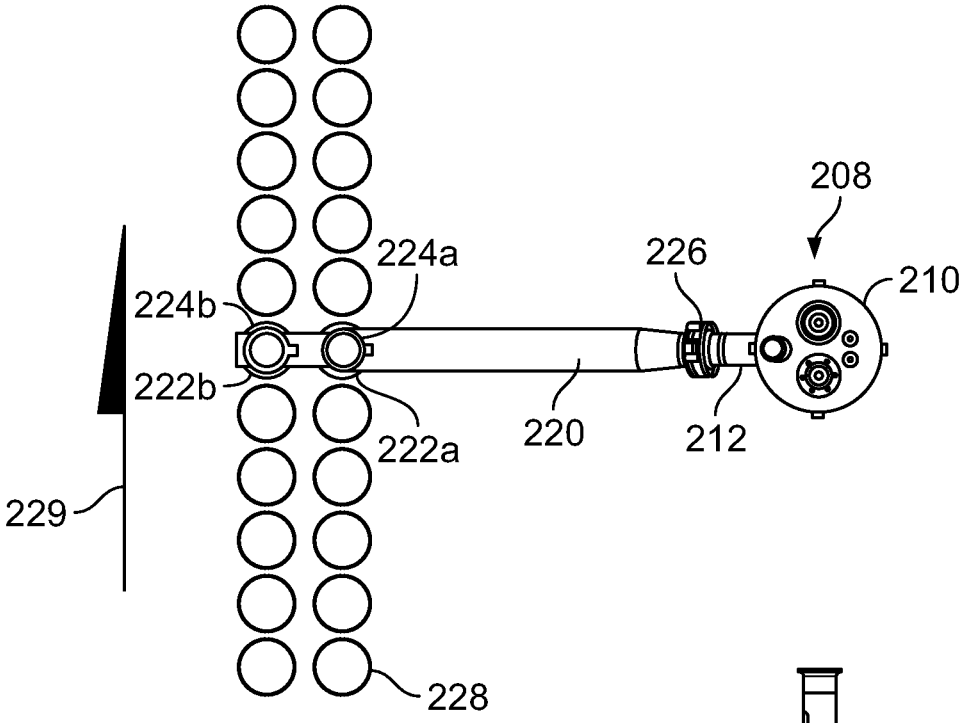
FIG. 16B is a top plan view of the doser of FIG. 16A with containers running beneath the multiple dosing heads.
Figure 16C:
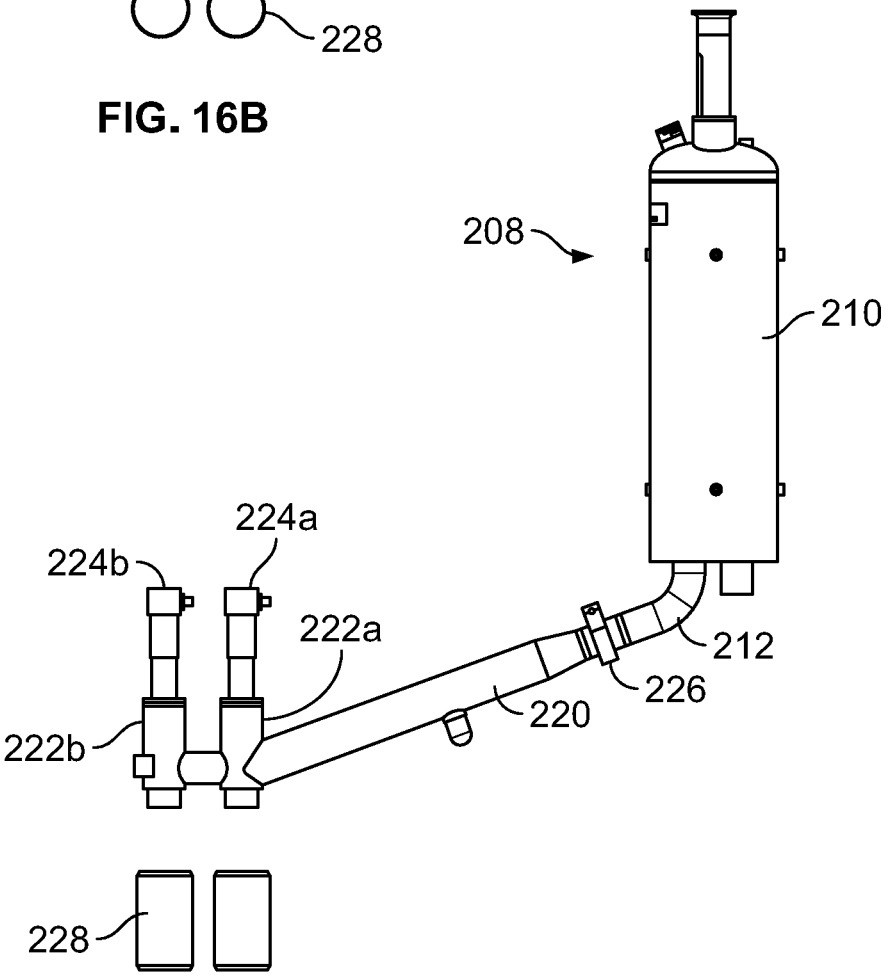
FIG. 16C is a side elevational view of the doser and containers of FIG. 16B.
Figure 17:
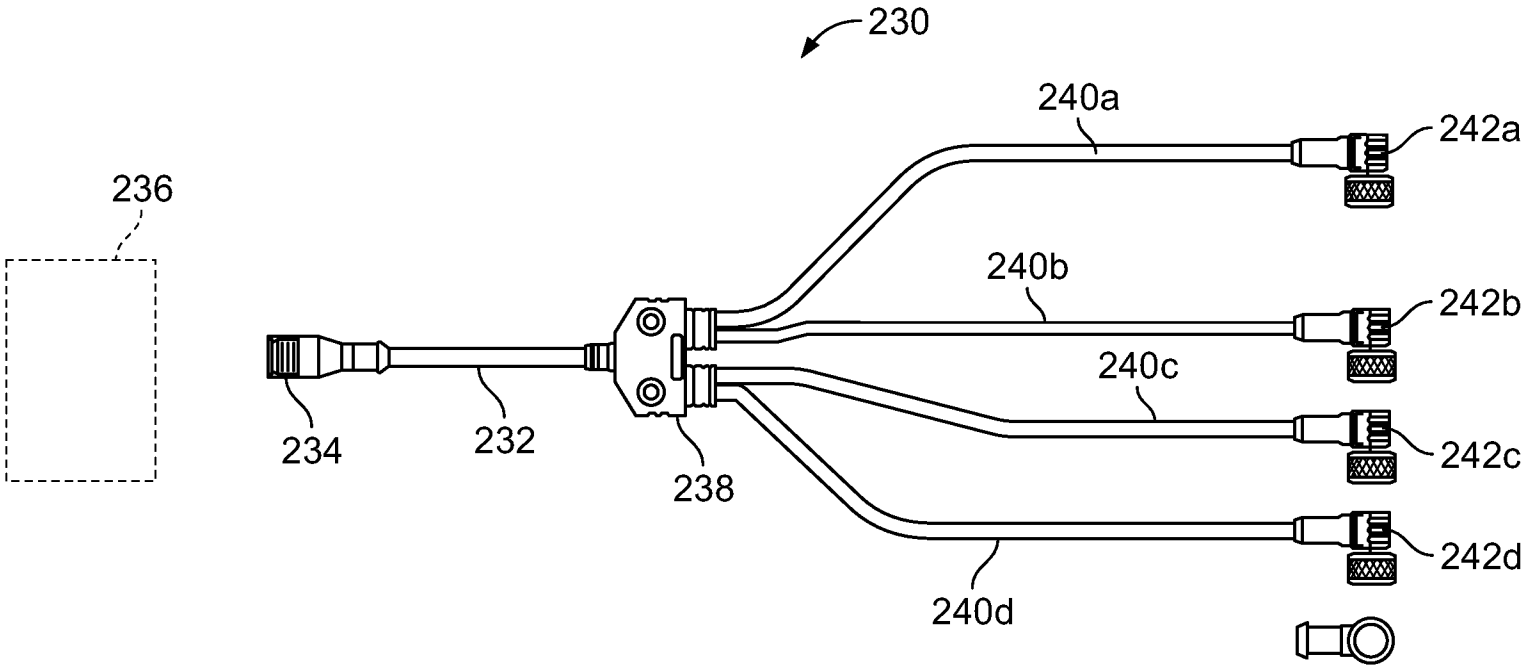
FIG. 17 is a schematic view of a dose actuator split control cable suitable for use with the embodiment illustrated in FIGS. 16A-16C and other embodiments.
Figure 18:
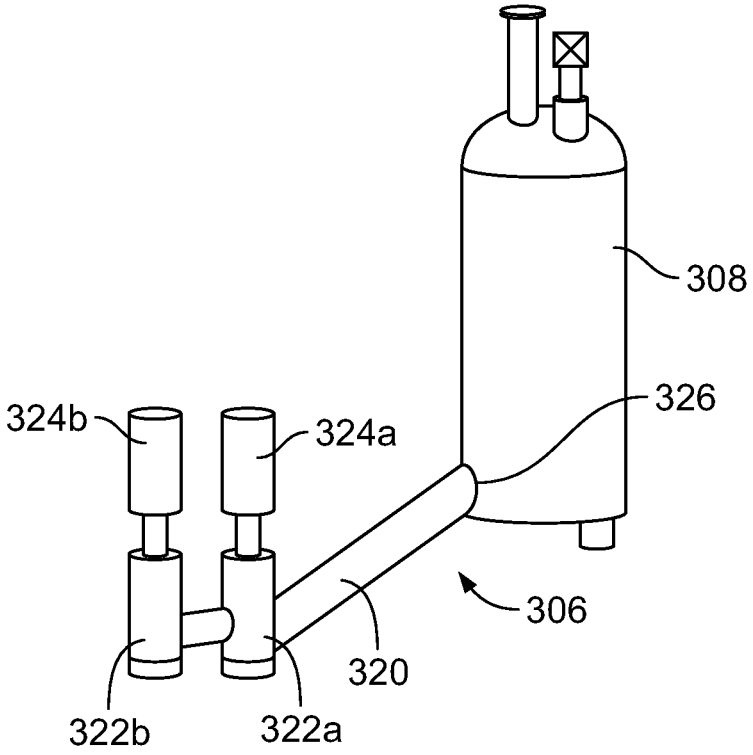
FIG. 18 is a schematic view of a second embodiment of the doser of the disclosure.

In the embodiments of the disclosure illustrated in FIGS. 16-18, one liquid nitrogen doser is used with at least one vacuum insulated arm feeding more than one dosing heads. The embodiments described below eliminate the need to purchase and install multiple dosers for filling lines using multiple lane filling operations. Using the interchangeable arm technology described above, with reference to FIG. 16, multiple dosing heads may be added at the end of a dosing arm to dose multiple lanes at one time from one dosing body.

As described below, the multiple dosing heads may be attached to a fixed dosing arm or interchangeable dosing arm.

A doser system including an embodiment of the multiple head dosing arm of the disclosure is indicated in general at 208 in FIGS. 16A-16C. The doser includes a doser body 210 that includes vents 214 and 218 and an inlet port 216. The remaining details of the doser body 210 may be as described above for doser body 42 of FIGS. 2-4. The doser body receives liquid nitrogen (or other cryogenic liquid) via inlet port 216 that is attached to a liquid nitrogen supply line.

A vacuum insulated gooseneck shaped outlet fitting 212 exits the bottom of the doser body 210 and, as described above, is removably attached via a bayonet connection and a clamp 226 to a vacuum insulated dosing arm 220. Multiple dosing heads 222*a*-222*c* are mounted upon the distal end of the dosing arm. The liquid nitrogen is held at atmospheric pressure within the doser body and is gravity fed down the arm to the dosing heads as dispensing occurs.

Dosing valve actuators 224*a*-224*c* are mounted to the tops of the dosing heads 222*a*-222*c*, respectively, and actuate dosing valves within the dosing heads 222*a*-222*c* to open and close the dosing valve within each dosing head. As a result, droplets of liquid nitrogen are dispensed in very precise amounts ("dosed") from the dosing heads 222*a*-222*c* into containers 228 (FIGS. 16B and 16C) or other receptacles passing below the dosing heads on individual (or combined) conveyor or other assembly line systems, as indicated by arrow 229 in FIG. 16B.

As examples only, the valves within dosing heads 222*a*-222*c* may be stem actuated valves, pneumatic or electric solenoid valves that are individually controlled by a system controller. As an example only, the controller may include a microprocessor or other electronic control device.

The system controller may communicate with the dosing valve actuators via a dose actuator split control cable, an example of which is illustrated in FIG. 17 and indicated in general at 230. The control cable features trunk cable portion 232 with a connector 234 positioned at one end. The connector attaches to the system controller, indicated in phantom at 236. The other end of the trunk portion 232 is connected to a cable junction 238. Branch cable portions 240*a*-240*d* are connected to cable junction 238 by their proximal ends. The distal ends of the branch cable portions 240*a*-240*d* are provided with connectors 242*a*-242*d* which connect to the dosing valve actuators (such as 224*a*-224*c* plus an additional dosing valve actuator, not shown, as 224*d*).

The system controller 236 and/or other components of the system may be configured so that the multiple dosing heads and actuators are activated so as to dose simultaneously or independently of one another.

As illustrated in FIG. 18, in an alternative embodiment, an insulated dosing arm 320 provided with multiple dosing heads 324*a*-324*b* and corresponding dosing valve actuators 324*a*-324*b*, is mounted by its proximal end 326 in a fixed fashion to the side of a doser body 308. The remaining aspects of this system are as described above with respect to FIGS. 16A-16C.

Figure 19A:
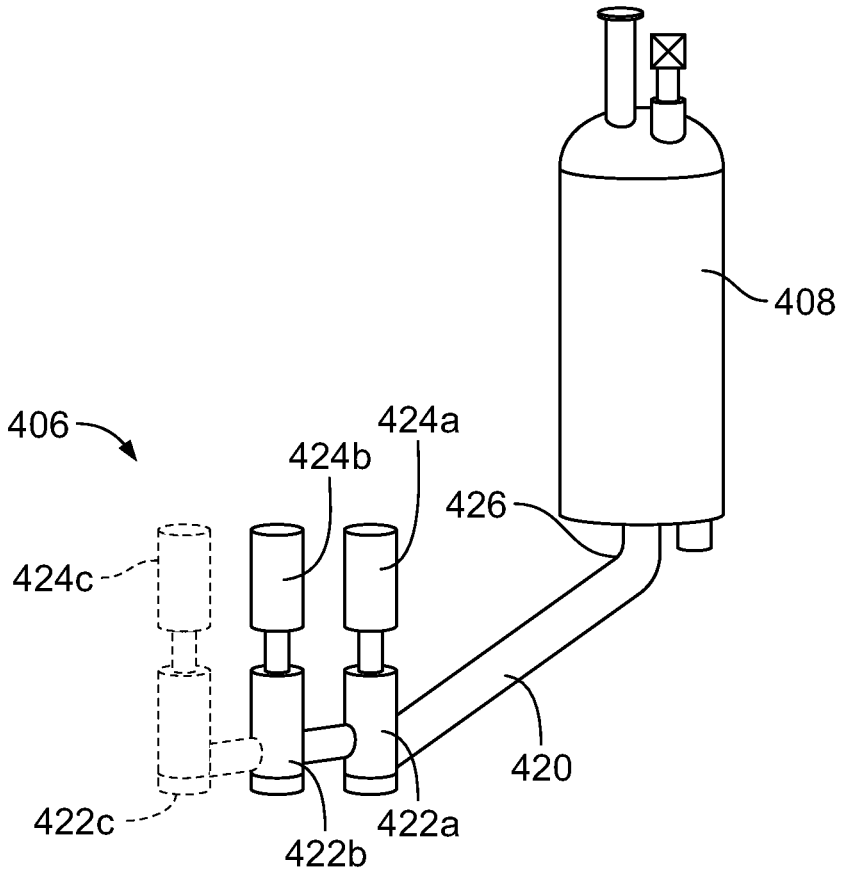
FIG. 19A is a perspective view of a third embodiment of the doser of the disclosure.
Figure 19B:
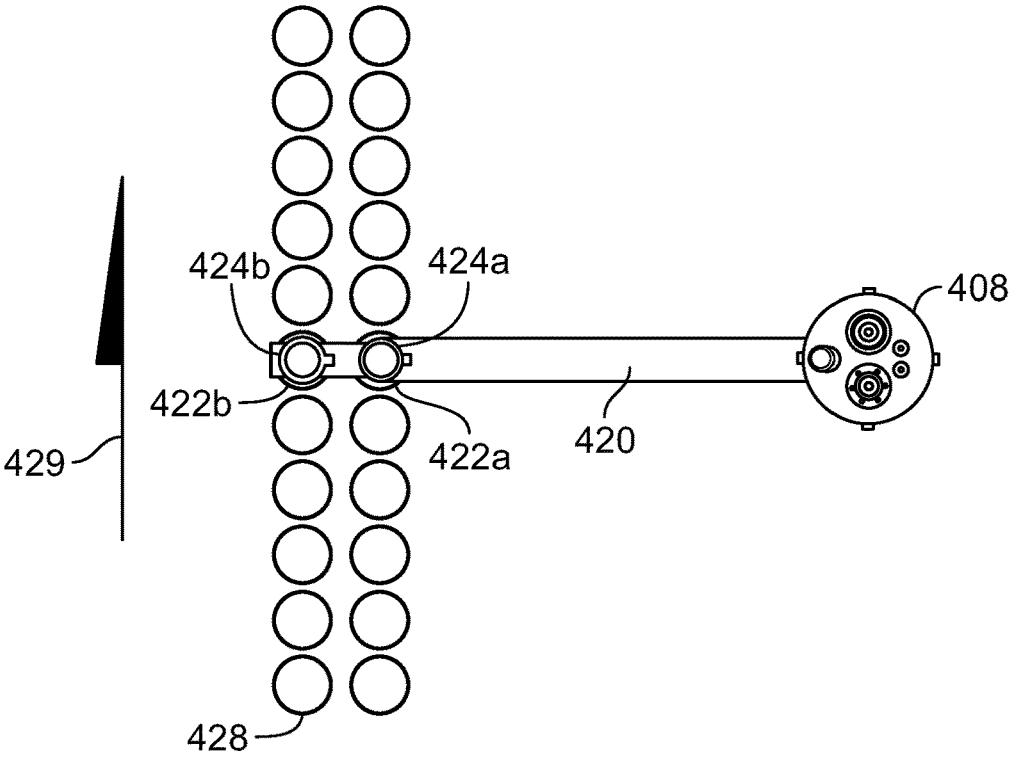
FIG. 19B is a top plan view of the doser of FIG. 19A with containers running beneath the multiple dosing heads.
Figure 19C:
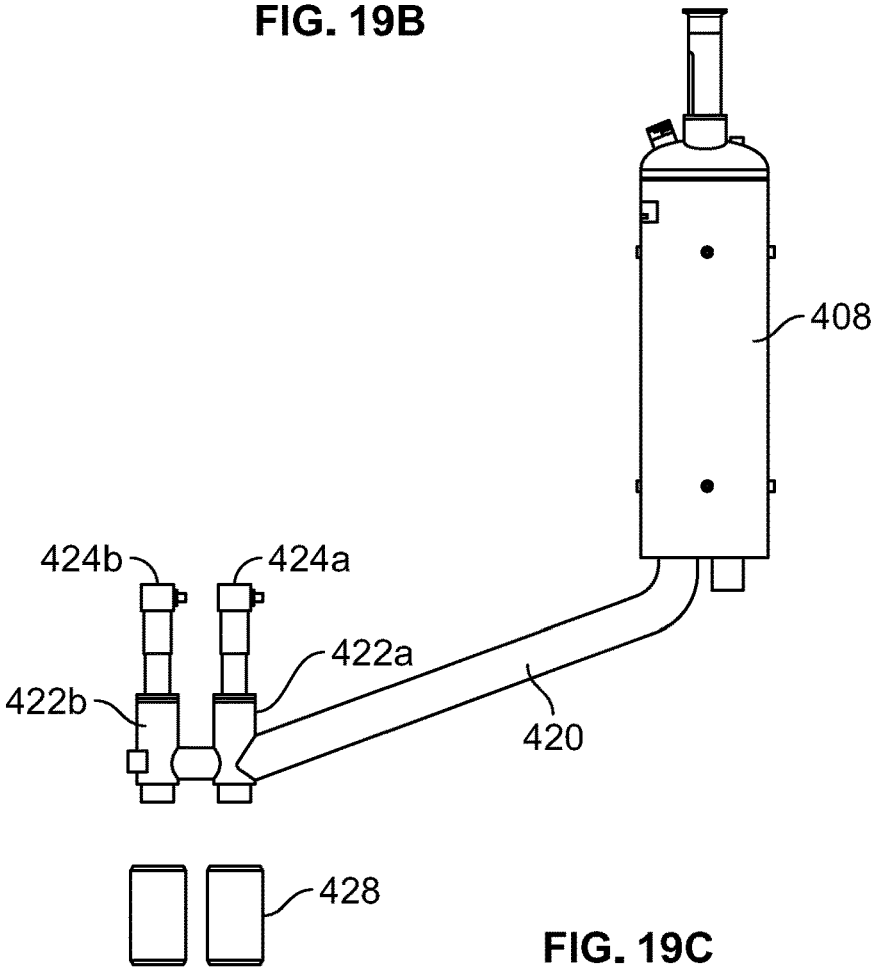
FIG. 19C is a side elevational view of the doser and containers of FIG. 19B.

As illustrated in FIGS. 19A-19C, in an another alternative embodiment, an insulated dosing arm 420 provided with multiple dosing heads 424*a*-424*c* and corresponding dosing valve actuators 424*a*-424*c*, is mounted by its proximal end 426 in a fixed fashion to the bottom of a doser body 408. The remaining aspects of this system are as described above with respect to FIGS. 16A-16C. As a result, liquid nitrogen is dosed from the dosing heads 422*a*-422*c* into containers 428 (FIGS. 19B and 19C) or other receptacles passing below the dosing heads on individual (or combined) conveyor or other assembly line systems, as indicated by arrow 429 in FIG. 19B.

It is to be understood that the invention is not limited to multiple heads in a linear pattern, as illustrated in FIGS. 16A-19C, or the number of multiple dosing heads shown. Rather, the invention encompasses multiple dosing heads in any number and orientation being fed by one dosing body. The illustrated embodiments all show linearly patterned dosing heads at the end of one arm. Other patterns and stack-ups can also be used. Non-limiting examples are presented in FIGS. 20A-23B.

Figure 20A:
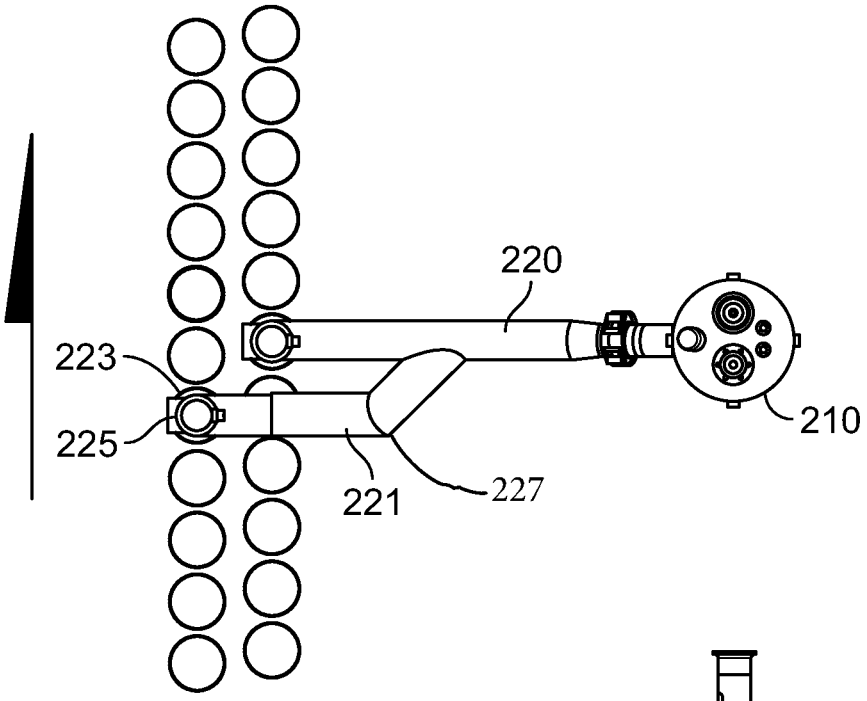
FIG. 20A is a top plan view of a fourth embodiment of the doser of the disclosure with containers running beneath the multiple dosing heads.
Figure 20B:
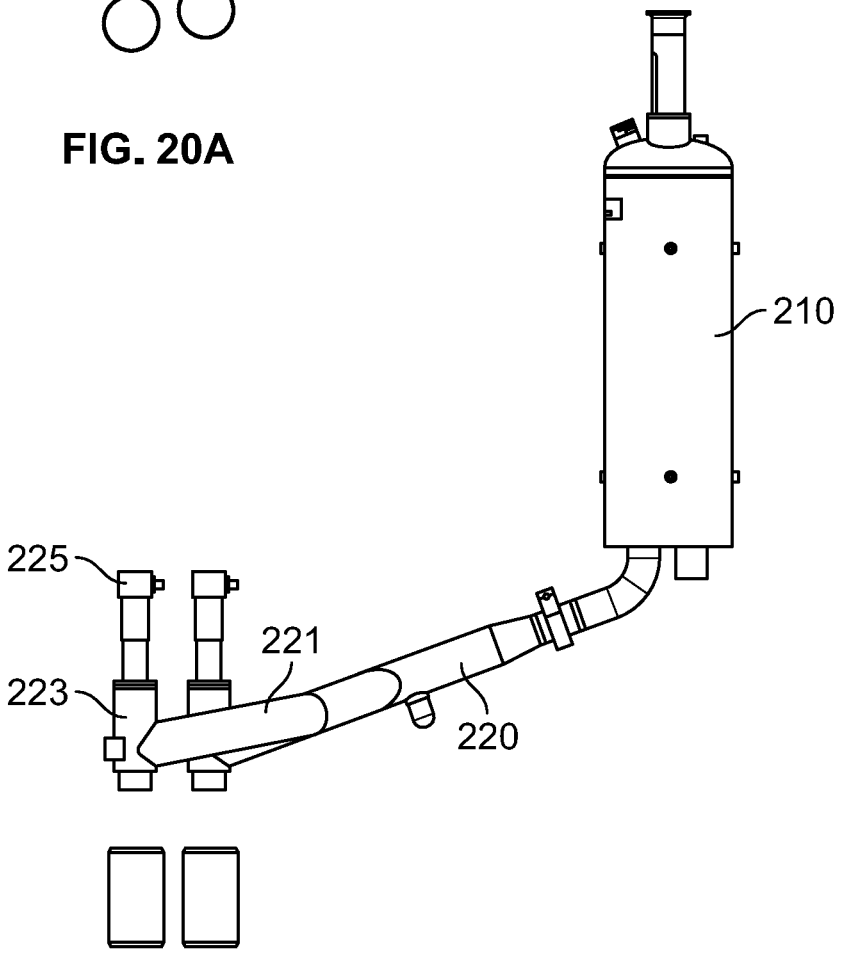
FIG. 20B is a side elevational view of the doser and containers of FIG. 20A.

In an alternative embodiment, FIGS. 20A and 20B illustrate the doser of FIGS. 16A-16C where an additional branch arm 221 is provided off of arm 220. This additional branch arm is provided with dosing head 223 and dosing head actuator 225 at the distal end and an elbow 227 between the proximal end, which joins arm 220, and the distal end.

Figure 21A:
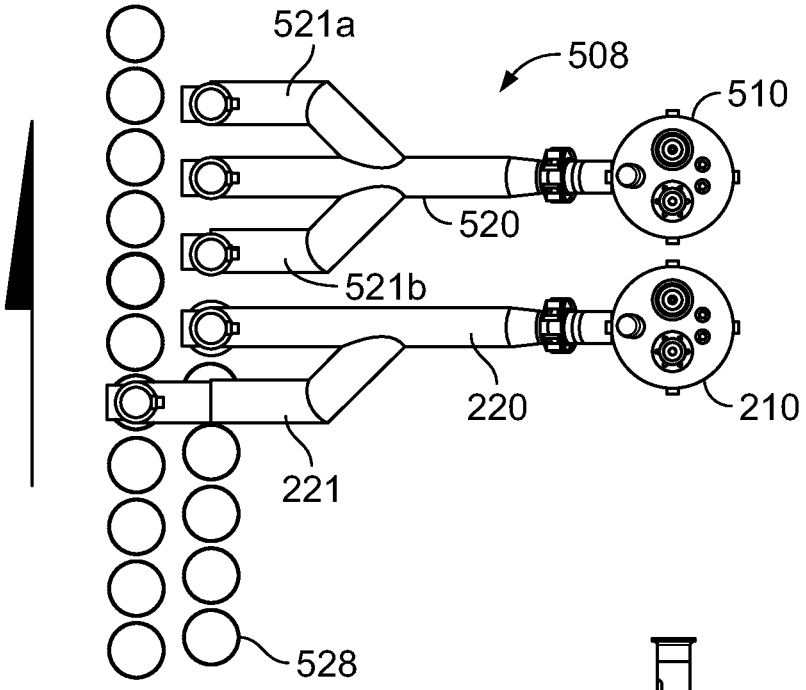
FIG. 21A is a top plan view of an embodiment of the disclosure featuring multiple dosers with containers running beneath the multiple dosing heads.
Figure 21B:
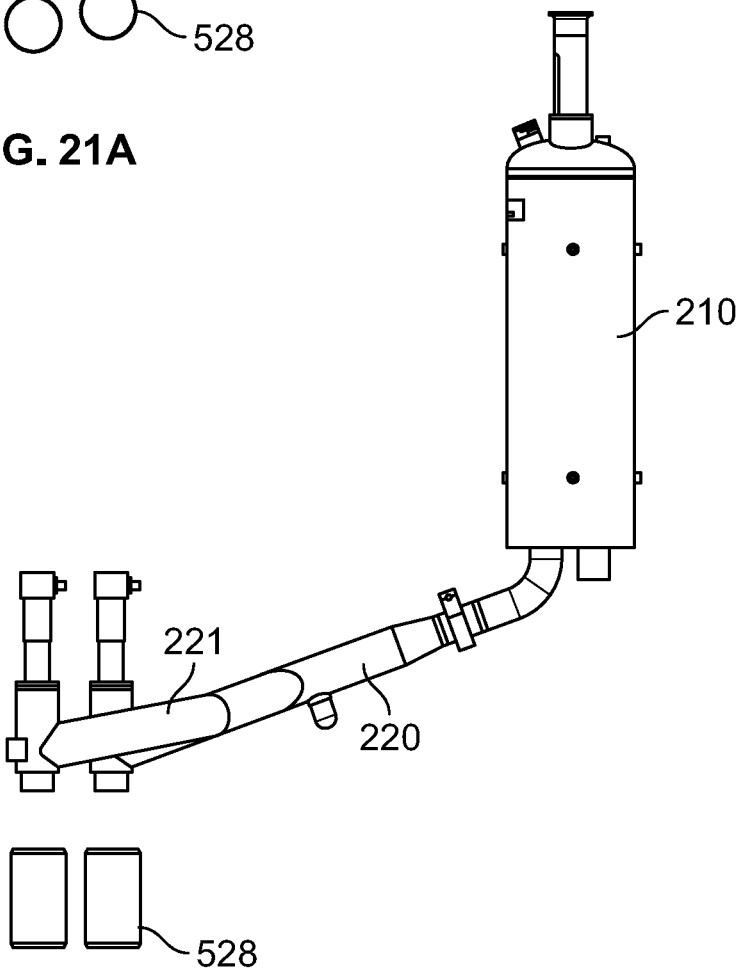
FIG. 21B is a side elevational view of the dosers and containers of FIG. 21A.

In another alternative embodiment, illustrated in FIGS. 21A and 21B, a second doser, indicated in general at 508, has been added and positioned next to the doser of FIGS. 20A and 20B. Doser 508 includes a doser body 510 that is positioned next to the doser body 210 of FIGS. 20A and 20B. Doser 508 also includes a pair of branch arms 521*a* and 521*b* flanking arm 520, with a dosing head and dosing head actuator position at each of the distal ends of arms 520, 521*a* and 521*b*. In FIGS. 21A and 21B, the doser 508 is used to dose containers running beneath the dosing heads of arms 520, 521*a* and 521*b* in a sequential or serial fashion.

Figure 22A:
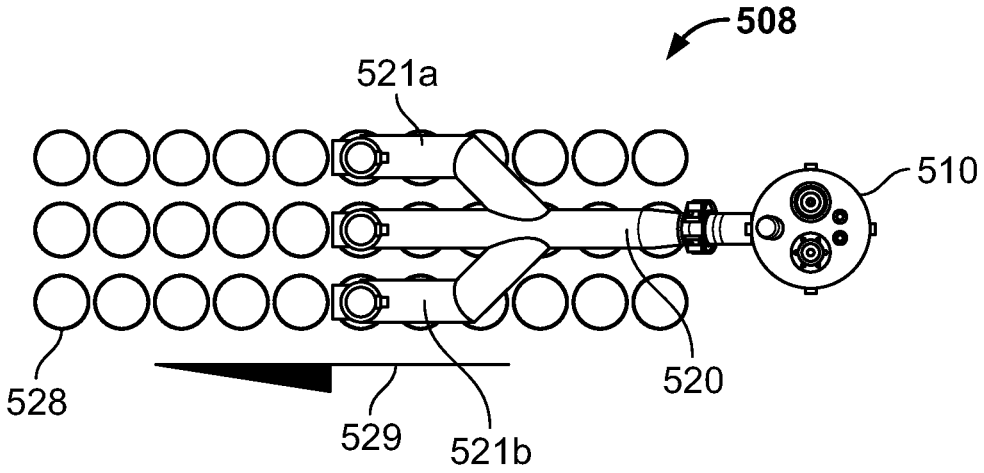
FIG. 22A is a top plan view of one of the dosers of FIGS. 21A and 21B with containers running beneath the multiple dosing heads in an alternative direction.
Figure 22B:
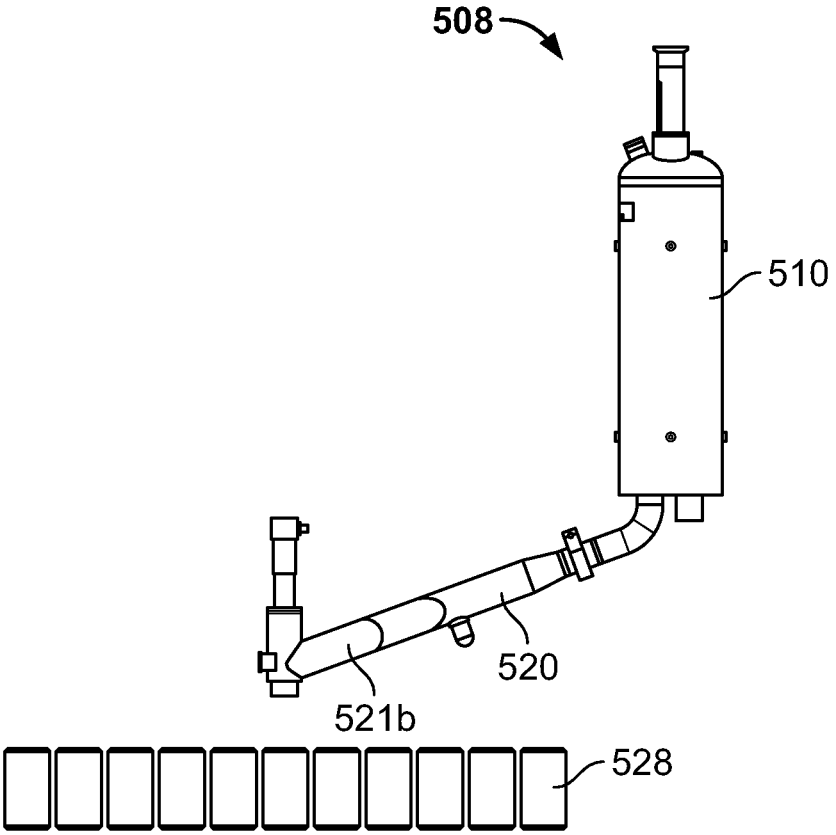
FIG. 22B is a side elevational view of the doser and containers of FIG. 22A

With reference to FIGS. 22A and 22B, the doser 508 of FIGS. 21A and 21B may alternatively be used to dose containers 528 running beneath each dosing head in a parallel fashion, as indicated by arrow 529 (FIG. 22A).

Figure 23A:
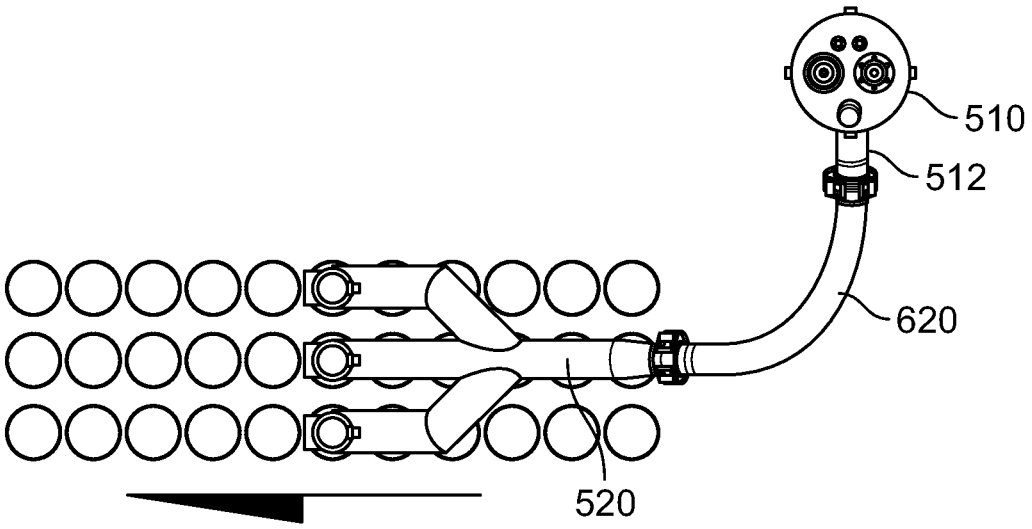
FIG. 23A is a top plan view of the doser of FIGS. 22A and 22B with a curved adapter arm and containers running beneath the multiple dosing heads.
Figure 23B:
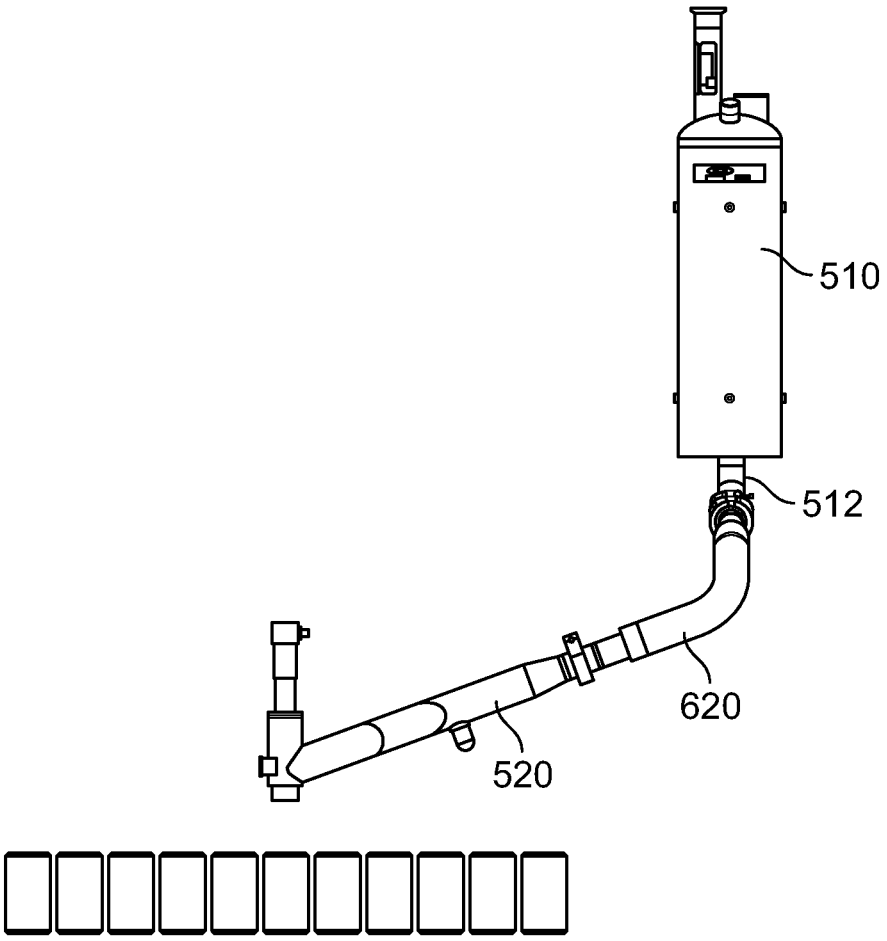
FIG. 23B is a side elevational view of the doser and containers of FIG. 23A.

As illustrated in FIGS. 23A and 23B, a curved adapter arm 620 may be positioned and connected between the outlet fitting 512 exiting doser body 510 and arm 520. As a result, the positioning of the multiple dosing heads and actuators may be quickly, inexpensively and easily altered.

While the preferred embodiments of the disclosure have been shown and described, it will be apparent to those skilled in the art that changes and modifications may be made therein without departing from the spirit of the disclosure, the scope of which is defined by the following claims.

What is claimed is:

1. A doser for dispensing a cryogenic fluid comprising:

a. a doser body configured to receive the cryogenic fluid;

b. a dosing arm having a proximal end and a distal end, said dosing arm having a central passage extending between the proximal and distal ends and configured to receive cryogenic fluid from the doser body;

c. a plurality of dosing heads with a first one of the plurality of dosing heads individually mounted to the distal end of the dosing arm and a second one of the plurality of dosing heads individually mounted to a branch arm and each of the plurality of dosing heads including a dosing valve and configured to receive cryogenic fluid from the central passage of the dosing arm and to dispense the cryogenic fluid when the dosing valve is opened;

d. said branch arm including a branch arm proximal end mounted to the dosing arm, a branch arm distal end individually mounted to the at least second one of the plurality of dosing heads and an elbow positioned between the branch arm proximal end and the branch arm distal end; wherein the distal end of the branch arm extends beyond the distal end of the dosing arm in a direction from the distal end of the dosing arm, wherein the direction is parallel to a longitudinal axis of the dosing arm and perpendicular to a dispensing direction of the plurality of dosing heads.

2. The doser of claim 1 wherein the proximal end of the dosing arm is removably attached to the doser body.

3. The doser of claim 2 further comprising a bayonet connection removably connecting the proximal end of the dosing arm to the doser body.

4. The doser of claim 2 wherein the dosing arm proximal end includes a female bayonet connector.

5. The doser of claim 2 further comprising an outlet fitting in fluid communication with the doser body, said outlet fitting provided with a male bayonet connector having an insertion stem removably positioned within the central passage of the dosing arm.

6. The doser of claim 1 wherein the doser body includes a doser body outer jacket and an inner tank positioned within the doser body outer jacket so that a doser body insulation space is defined therebetween, said space evacuated of air.

7. The doser of claim 1 wherein the cryogenic fluid is liquid nitrogen.

8. The doser of claim 1 wherein the dosing arm is insulated.

9. The doser of claim 1 wherein the proximal end of the dosing arm is fixedly attached to a side of the dosing body.

10. The doser of claim 1 wherein the proximal end of the dosing arm is fixedly secured to a bottom of the dosing body.

11. The doser of claim 1 further comprising a plurality of actuators with one of the plurality of actuators for each dosing valve for independently opening and closing the plurality of dosing valves.

12. The doser of claim 1 further comprising a plurality of branch arms individually mounting the plurality of dosing heads to the dosing arm so that the plurality of dosing heads each receives cryogenic fluid in parallel.

13. The doser of claim 1 wherein the branch arm is mounted to the dosing arm at an angle less than 90 degrees.

14. The doser of claim 1 wherein the elbow forms an angle of greater than 90 degrees.

15. A dosing arm device comprising a dosing arm including a proximal end and a distal end and a central passage extending between the proximal and distal ends that is configured to receive a cryogenic fluid and a plurality of dosing heads, a first one of said plurality of dosing heads individually mounted to the distal end of the dosing arm and a second one of the plurality of dosing heads individually mounted to the dosing arm by a branch arm and each of the plurality of dosing heads including a dosing valve and configured to receive cryogenic fluid from the central passage and to dispense the cryogenic fluid when the dosing valve is opened, said branch arm including a branch arm proximal end mounted to the dosing arm, a branch arm distal end individually mounted to the second one of the plurality of dosing heads and an elbow positioned between the branch arm proximal end and the branch arm distal end; wherein the distal end of the branch arm extends beyond the distal end of the dosing arm in a direction from the distal end of the dosing arm, wherein the direction is parallel to a longitudinal axis of the dosing arm and perpendicular to a dispensing direction of the plurality of dosing heads.

16. The dosing arm device of claim 15 further comprising:

a. a dosing arm outer jacket;

b. a dosing arm inner pipe positioned within the dosing arm outer jacket and having the central passage;

c. a sleeve connected to the dosing arm outer jacket and inner pipe at a proximal end of the dosing arm so that a sealed annular space is defined between the dosing arm outer jacket and the inner pipe, said annular space evacuated of air.

17. The dosing arm device of claim 15 further comprising a plurality of branch arms individually mounting the plurality of dosing heads to the dosing arm so that the plurality of dosing heads each receives cryogenic fluid in parallel.

18. The dosing arm device of claim 15 wherein the branch arm is mounted to the dosing arm at an angle less than 90 degrees.

* * * * *